US011657986B2

(12) United States Patent
Gottschalk et al.

(10) Patent No.: US 11,657,986 B2
(45) Date of Patent: May 23, 2023

(54) DAMPER AND LATCHING ASSEMBLIES FOR ELECTRICAL SWITCHING DEVICES

(71) Applicant: Eaton Intelligent Power Limited, Dublin (IE)

(72) Inventors: Andrew L. Gottschalk, Monaca, PA (US); Robert Michael Slepian, Murrysville, PA (US); Jayaraman Muniyappan, Tamil Nadu (IN); Santhosh Kumar Chamarajanagar Govinda Nayaka, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/385,716

(22) Filed: Jul. 26, 2021

(65) Prior Publication Data

US 2023/0024766 A1 Jan. 26, 2023

(51) Int. Cl.

| | |
|---|---|
| ***H01H 9/20*** | (2006.01) |
| ***H01H 3/60*** | (2006.01) |
| ***H01H 71/10*** | (2006.01) |
| ***H01H 1/58*** | (2006.01) |
| ***H01H 1/24*** | (2006.01) |
| ***H01H 1/52*** | (2006.01) |

(52) U.S. Cl.

CPC ..... *H01H 9/20* (2013.01); *H01H 1/242* (2013.01); *H01H 1/52* (2013.01); *H01H 1/5833* (2013.01); *H01H 3/60* (2013.01); *H01H 71/10* (2013.01)

(58) Field of Classification Search

CPC ..... H01H 1/242; H01H 1/52; H01H 1/5833; H01H 3/60; H01H 71/10

See application file for complete search history.

(56) References Cited

U.S. PATENT DOCUMENTS

| | | | | |
|---|---|---|---|---|
| 4,029,923 A * | 6/1977 | Meyer | H01H 3/40 218/78 |
| 4,283,610 A * | 8/1981 | Date | H01H 3/30 218/12 |
| 6,316,739 B1 * | 11/2001 | Ohtsuka | H01H 3/30 200/501 |
| 9,685,283 B2 * | 6/2017 | Darko | H01H 9/24 |

FOREIGN PATENT DOCUMENTS

| | | |
|---|---|---|
| CH | 370 828 A | 7/1963 |
| GB | 206 980 A | 9/1970 |

OTHER PUBLICATIONS

European Patent Office "International Search Report and Written Opinion", for corresponding International Application No. PCT/EP2022/025340, dated Nov. 18, 2022, 11 pp.

* cited by examiner

*Primary Examiner* — Vanessa Girardi

(74) *Attorney, Agent, or Firm* — Eckert Seamans Cherin & Mellott, LLC

(57) ABSTRACT

An electrical switching device, such as a high-speed switching device, has a damper and latching assembly. The assembly is configured to dampen the movement of a moving contact of the switching device as the moving contact translates from its closed position to its open position. The assembly also is configured to restrain the moving contact in its open position. The assembly stores at least some of the energy associated with the damping process, and uses the stored energy to assist in the release of the moving contact during the subsequent re-closing of the switching device.

18 Claims, 15 Drawing Sheets

DAMPER AND LATCHING ASSEMBLIES FOR ELECTRICAL SWITCHING DEVICES

BACKGROUND

This disclosure relates generally to electrical switching devices. More particularly, this disclosure describes a high-speed switching device having a damper and latching assembly. The assembly is configured to dampen the movement of a moving contact of the switching device as the moving contact translates from its closed position to its open position. The assembly also is configured to restrain the moving contact in its open position. The assembly stores at least some of the energy associated with the damping process, and uses the stored energy to assist in the release of the moving contact during the subsequent re-closing of the switching device.

High-speed switching devices typically include one or more moving contacts that translate into and out of contact with an associated stationary contact, to selectively establish and disestablish a path for conducting electric current. The moving contact typically is mounted on a linearly-translating switch shaft. Under routine operating conditions, the moving contact is biased against the stationary contact so that current is transmitted through the switching device by way of the moving and stationary contacts. The bias may be provided by one or more linear springs, toggling washers, or other means.

It may become necessary to rapidly switch the current path during non-routine operating conditions. For example, during an overcurrent condition, the moving and stationary contacts need to be rapidly separated so that the fault current can be shunted to other electrical devices configured to interrupt, reduce, or otherwise handle the fault current. To achieve such rapid separation, the switch may be equipped with a high-speed coil, such as a Thomson coil, that causes the switch shaft, and the attached moving contact, to translate away from the stationary contact at a very high rate of speed. The switching device also may include a low-speed coil for opening the contacts under routine operating conditions, by causing the switch shaft and the moving contact to translate away from the stationary contact at a relatively low rate of speed. Once the moving contact reaches its open positon at the end of the fast or slow opening sequences, the moving contact is restrained in the open position, against the bias of the closing springs or the toggling washers, by some type of restraining means that engages the switch shaft.

The switch shaft may rebound upon reaching the end of its travel during the opening sequence. Such rebounding has the potential to cause the switch shaft to become free from its restraining means, which can result in the premature and unintentional return of the moving contact to its closed position. Rebounding also can result in premature wear of the switch shaft and other components. Due to the high rate of speed imparted to the moving contact by the high-speed solenoid, the switch may include a fast brake system that slows the switch shaft and the attached moving contact after the moving contact has separated from the stationary contact during the fast-opening sequence. The fast brake system operates during high-speed opening only, and reduces the potential for rebounding of the switch shaft.

Due to the operating characteristics of a typical secondary coil, the speed of the switch shaft and the moving contact may increase as the moving contact approaches its open position during the slow-opening sequence. Thus, the potential for rebounding of the switch shaft during the slow-opening sequence can be substantial.

Also, the force needed to latch or otherwise restrain the switch shaft and the moving contact against the bias of the closing springs or toggling washers can be substantial. Thus, the frictional or other forces that need to be overcome as the switch shaft is released during re-closing of the switch likewise can be substantial, and potentially can interfere with the re-closing of the switch.

SUMMARY

In one aspect, the disclosed technology relates to an electrical switching device that includes a sidewall, a first shaft configured to translate between a first and a second position in relation to the sidewall; a first contact mounted on the first shaft; and a second contact. The first contact and the first shaft are configured so that the first contact is in electrical contact with the second contact when the first shaft is in the first position, and the first contact is out of electrical contact with the second contact when the first shaft is in the second position.

The electrical switching device also includes a damper and latching assembly. The damper and latching assembly includes the first shaft; a second shaft mounted for rotation on the sidewall, the second shaft being configured so that, during operation, the first shaft rotates the second shaft from a first to a second angular position of the second shaft as the first shaft moves from the first to the second position of the first shaft; and a first rotating member mounted for rotation on the sidewall between a first and a second angular position. The first rotating member includes a third shaft. The third shaft is configured to, during operation, engage the first shaft when the first shaft is in the second position of the first shaft and the first rotating member is in the second angular position of the first rotating member. The engagement of the third shaft and the first shaft restraining the first shaft in the second position of the first shaft.

The damper and latching assembly also includes a spring coupled to the second shaft and configured so that, during operation, rotation of the second shaft from the first to the second angular position of the second shaft imparts energy to the spring, and at least a portion of the energy imparted to the spring biases the first rotating member toward the first angular position of the first rotating member as the first rotating member rotates from the second to the first angular position of the first rotating member.

In another aspect of the disclosed technology, the first shaft is biased toward the first position of the first shaft and is configured to, during operation, move from the second to the first position of the first shaft as the first rotating member rotates from the second to the first angular position of the first rotating member.

In another aspect of the disclosed technology, the damper and latching assembly further includes a second rotating member mounted on the second shaft and configured so that, during operation, rotation of the second shaft from the first to the second angular position of the second shaft causes the second rotating member to rotate from a first to a second angular position of the second rotating member; and a third rotating member mounted for rotation on the sidewall. The third rotating member is coupled to the second rotating member and the spring and is configured so that, during operation, rotation of the second rotating member from the first to the second angular position of the second rotating member causes the third rotating member to rotate from a first to a second angular position of the third rotating member, and the third rotating member imparts the energy to the spring as the third rotating member is rotated from the first to the second angular position of the third rotating member.

In another aspect of the disclosed technology, the first rotating member is configured so that, during operation, rotation of the third rotating member from the first to the second angular position of the third rotating member causes the first rotating member to rotate from the first to the second angular position of the first rotating member.

In another aspect of the disclosed technology, the spring is a first spring; the damper and latching assembly further includes a second spring coupled to the first rotating member and the sidewall; and the second spring is configured to, during operation, bias the first rotating member toward the second angular position of the first rotating member.

In another aspect of the disclosed technology, the spring is a torsion spring and is configured so that, during operation, the rotation of the third rotating member from the first to the second angular position of the third rotating member imparts the energy to the spring by winding the spring.

In another aspect of the disclosed technology, the energization of the spring dampens the movement of the first shaft from the first to the second position of the first shaft.

In another aspect of the disclosed technology, the third shaft has a substantially D-shaped cross section.

In another aspect of the disclosed technology, the damper and latching assembly further includes a coupling member, a mounting pin that engages the coupling member and the second rotating member, and a coupling pin that engages the coupling member and the third rotating member. The second rotating member is coupled to the third rotating member by way of the coupling member, the mounting pin, and the coupling pin. The coupling member is configured so that, during operation, the coupling pin is disengaged from the third rotating member when the second rotating member is in the second angular position of the second rotating member thereby decoupling the third rotating member from the second rotating member.

In another aspect of the disclosed technology, the third rotating member includes a side member having an opening formed therein; and the coupling pin is configured to, during operation, reside within the opening and out of contact with the third rotating member when the second rotating member is in the second angular position of the second rotating member.

In another aspect of the disclosed technology, the damper and latching assembly further includes a solenoid, and a paddle connected to the solenoid. The solenoid is configured to, during operation, rotate the paddle between a first and a second angular position of the paddle; and the paddle is configured to contact the third rotating member when the third rotating member is in the second angular position of the third rotating member, and to rotate the third rotating member toward the first angular position of the third rotating member as the paddle moves from the first to the second angular position of the paddle.

In another aspect of the disclosed technology, the spring is further configured to, during operation, bias the third rotating member toward the first angular position of the third rotating member as the third rotating member rotates from the second to the first angular position of the third rotating member.

In another aspect of the disclosed technology, the spring is further configured to bias the third rotating member toward the first position of the third rotating member using at least a portion of the energy imparted to the spring by the rotation of the second shaft from the first to the second angular position of the second shaft.

In another aspect of the disclosed technology, the spring is further configured to, during operation, bias the third rotating member toward the second position of the third rotating member when the third rotating member is in the second angular position of the third rotating member.

In another aspect of the disclosed technology, the third rotating member is configured so that, during operation, the third rotating member rotates the third shaft from the second to the first position of the third shaft as the third rotating member rotates from the second to the first position of the third rotating member, thereby releasing the first shaft from the third shaft.

In another aspect of the disclosed technology, the first shaft includes a step, and the third shaft is further configured to, during operation, engage the step when the first shaft is in the second position of the first shaft and the first rotating member is in the second angular position of the first rotating member; and the engagement of the step and the first shaft restrains the first shaft in the second position of the first shaft.

In another aspect of the disclosed technology, the spring is a first spring; the damper and latching assembly further includes a second spring coupled to the coupling member and the second rotating member; and the second spring is configured to, during operation, bias the coupling member in an orientation at which coupling pin remains disengaged from the third rotating member when the second rotating member is in the second angular position of the second rotating member.

In another aspect of the disclosed technology, the first shaft has a substantially planar surface; the second shaft has a substantially planar surface configured to, during operation, contact the surface of the first shaft as the first shaft rotates the second shaft from the first to the second angular position of the second shaft; and an orientation of the surface of the first shaft substantially matches an orientation of the surface of the second shaft as the first shaft rotates the second shaft from the first to the second angular position of the second shaft.

In another aspect of the disclosed technology, the first shaft is configured to, during operation, prevent rotation of the first rotating member from the first to the second position of the first rotating member when the first shaft is in the first position of the first shaft.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

Other terms that are relevant to this disclosure will be defined at the end of this Detailed Description section.

Figure 1:
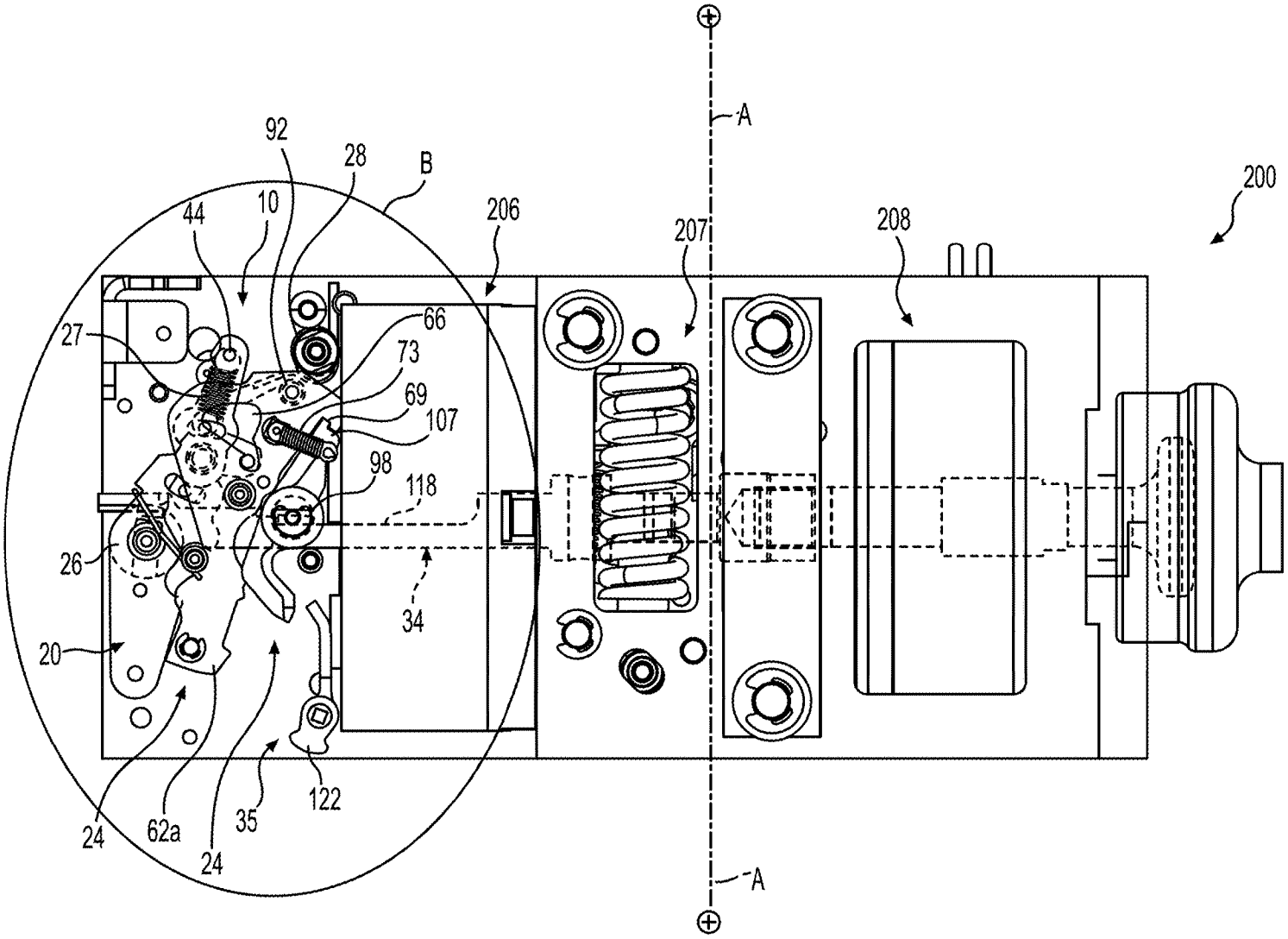
FIG. 1 is a side view of an electrical switch having a damper and latching assembly, with a sidewall of the switch removed for purposes of illustration, and showing the switch in a closed state.
Figure 2:
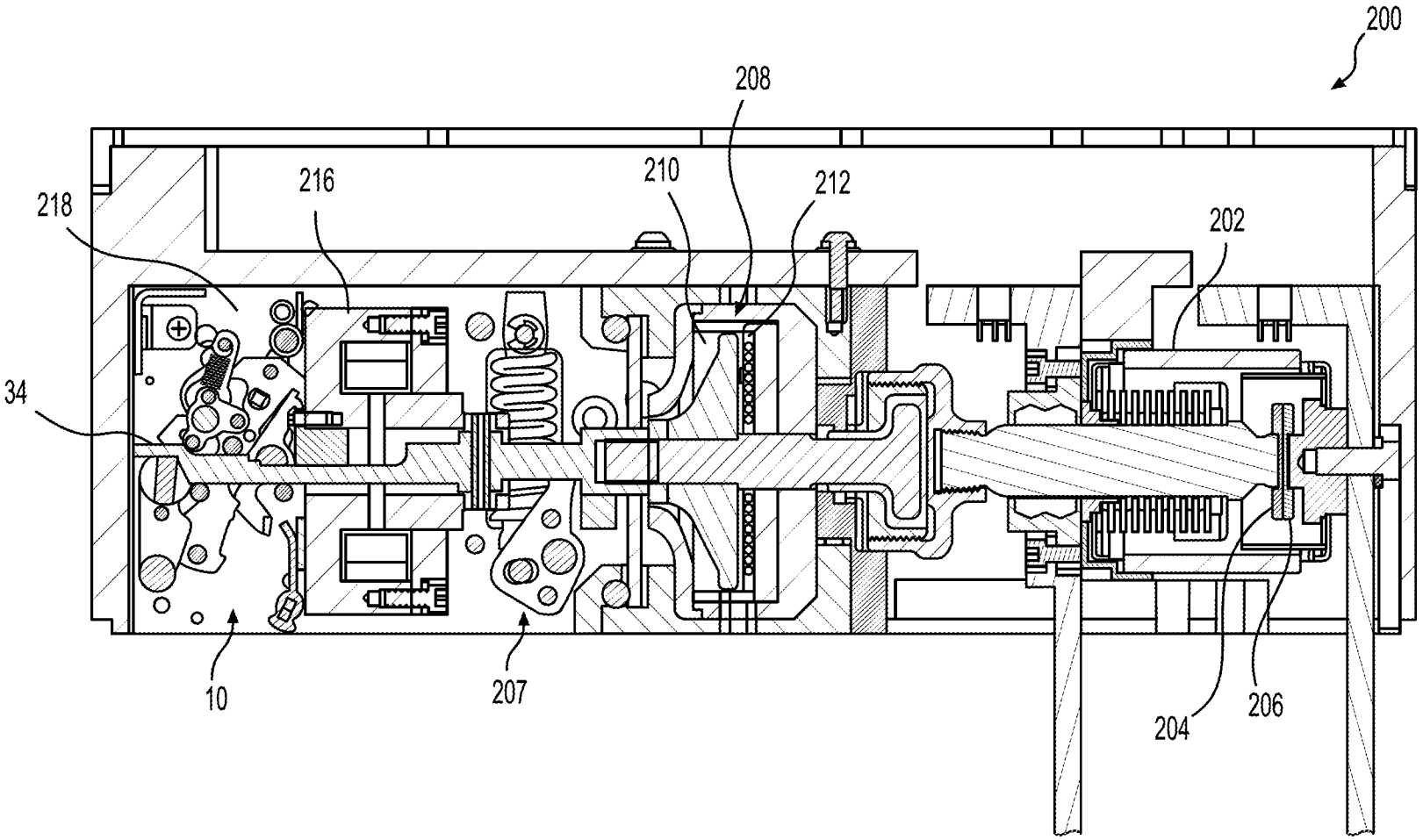
FIG. 2 is a cross-sectional view of the electrical switch shown in FIG. 1 without a case, taken through the line A-A of FIG. 1, showing the switch in the closed state, and depicting additional component of the switch.
Figure 5:
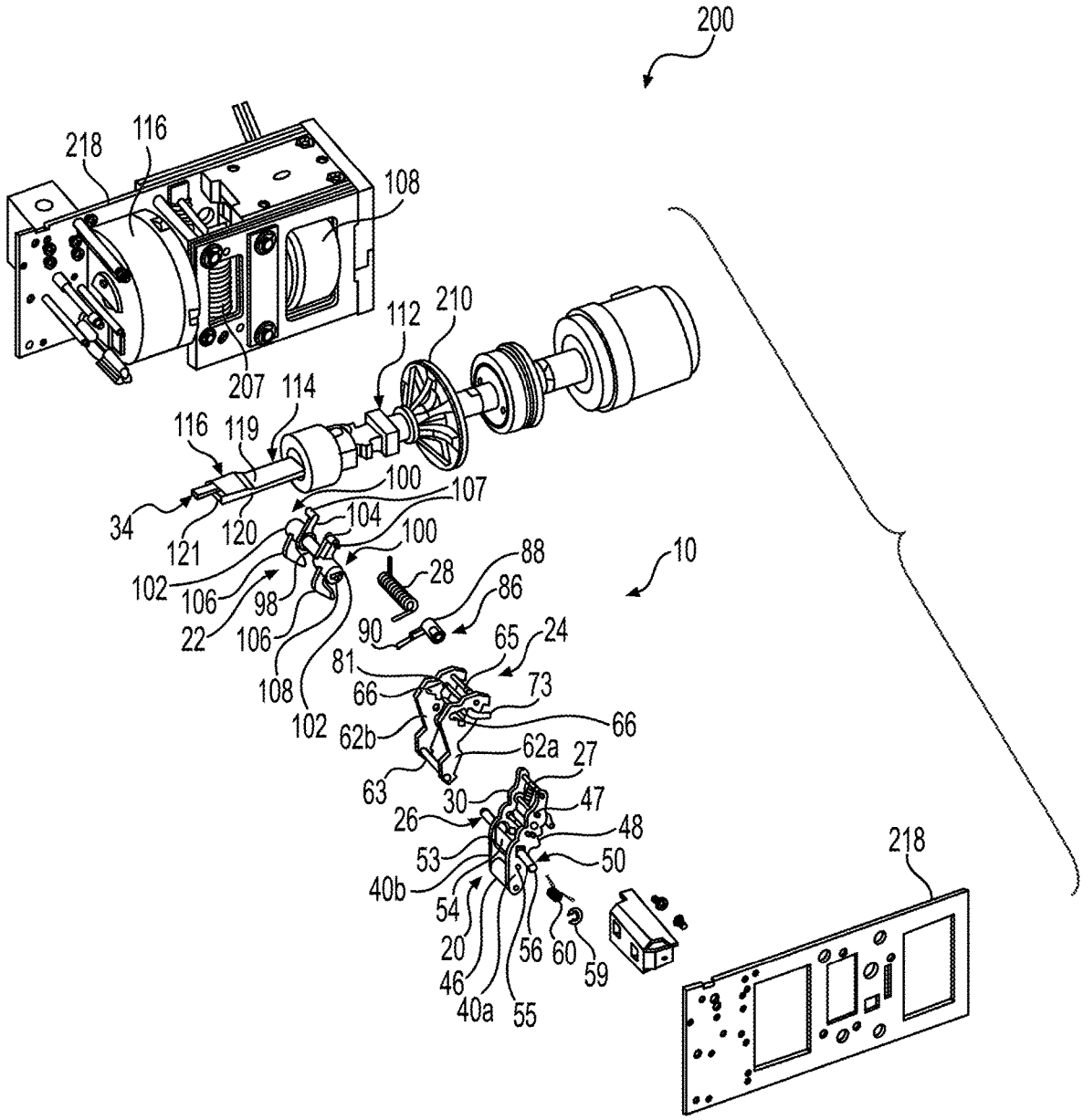
FIG. 5 is a partially exploded view of the electrical switch shown in FIGS. 1-4.

The figures depict a damper and latching assembly 10 for a switching device such an electrical switch 200. Referring initially to FIGS. 1, 2, and 5, the switch 200 comprises a switching assembly 202 configured to form a current path between a first and a second terminal (not shown) of the switch 200. The switching assembly 202 includes a first, or moving contact 204; and a second, or stationary contact 206, visible in FIG. 5. The moving contact 204 is securely mounted on a first end of a shaft in the form of a switch shaft 34; and is configured to translate linearly, between a first, or closed position depicted in FIG. 5, and a second, or open position (not shown). The moving contact 204, when in the closed position, is in physical and electrical contact with the stationary contact 206, thereby facilitating the flow of electric current between the first and second terminals. When in the open position, the moving contact 204 is spaced apart, and electrically isolated from the stationary contact 206; thus, current does not flow thorough the switch 200 when the moving contact 204 is in the open position.

The switch 200 also comprises a closing spring assembly 207 that biases the moving contact 204 toward its closed position, and into contact with the stationary contact 206. The closing spring assembly 207 can be, for example, a closing spring assembly as described in U.S. patent application Ser. No. 17/180,068, the contents of which are incorporated by reference herein in their entirety. Other means for biasing the moving contact 204 can be used in lieu of the closing spring assembly 207. For example, the biasing force can be provided by one or more toggling Bellville washers in alternative embodiments.

The switch 200 also includes a drive 208 configured to actuate the switching assembly 202. As can be seen in FIG. 5, the drive 208 includes a plunger 210; a high-speed or primary coil 212 located adjacent the plunger 210; and a low-speed or secondary coil 216. The plunger 210 is securely connected to a second end of the switch shaft 34. The primary coil 212 is used to open the switch 200 in a rapid, or fast-opening sequence. The secondary coil 216 is used to open in switch 200 in a slow-opening sequence. The primary coil 212 and the secondary coil 216 generate a varying magnetic flux when energized with a pulsating electric current during the respective fast and slow opening sequences. The magnetic flux induces an oppositely flowing electric current within the plunger 210. The opposing currents generate a repulsive force between the primary coil 212 or the secondary coil 216, and the plunger 210. The repulsive force drives the plunger 210, and the attached switch shaft 34, away from the primary coil 212. The primary coil 212 is a Thomson coil; other types of coils can be used in alternative embodiments.

The switch shaft 34 is configured to translate linearly between a first, or closing position and a second, or opening position. When in the closing position, the switch shaft 34 urges the moving contact 204 into its closed position against the stationary contact 206. When in the opening position, the switch shaft 34 holds the moving contact 204 is its open position, spaced apart from the stationary contact 206.

The switch shaft 34 resides in its closing position, depicted in FIGS. 1-4 and 6, when the primary coil 212 or the secondary coil 216 are not energized and the switch shaft 34 is not being restrained in its opening position by the damper and latching assembly 10. The movement of plunger 210 in response to energization of the primary coil 212 causes the switch shaft 34 to translate linearly, to its opening position, which in turn causes the moving contact 204 to translate rapidly toward its open position. The moving contact 204 is opened by the primary coil 212 when it is necessary to rapidly separate the moving contact 204 from the stationary contact 206, such as upon the detection of an overcurrent condition. For example, the primary coil 212 can be configured to cause the moving contact 204 to translate one millimeter in about 0.00025 seconds.

The switch 200 also includes a fast-brake system (not shown) that slows the switch shaft 34 and the moving contact 204 after the moving contact 204 has separated from the stationary contact 206 during the fast-opening sequence. The secondary coil 216 can be sized to the largest size possible that can be dampened reliably and not result in premature wear or parts damage, so that the damping force provided by the damper and latching assembly 10 also can be used to provide a slowing effect at the end of the fast opening sequence. Thus, the fast brake system can work less, which in turn can increase the reliability of the fast brake system. The secondary coil 216 can be sized in other manners in alternative embodiments.

The secondary coil 216 configured to move the switch shaft 34 to its opening position at a much slower rate than the primary coil 212. The secondary coil 216 is used to move the moving contact 204 under routine circumstances that do not require the nearly instantaneous separation of the moving contact 204 and the stationary contact 206 provided by the primary coil 212. The fast-brake system does not operate during the slow-opening sequence.

The switch 200 also includes two sidewalls 218 located on opposite sides of the switch 200, as shown in FIG. 1.

The damper and latching assembly 10 is configured to dampen the movement of the moving contact 204 and the switch shaft 34 as the moving contact 204 translates from its closed position to its open position. The assembly 10 also is configured to restrain the moving contact 204 in its open position. The assembly 10 stores at least some of the energy associated with the damping process, and uses the stored energy to assist in the release of the moving contact 204 during the subsequent re-closing of the switch 200.

Referring to FIGS. 1 and 3-5, the damper and latching assembly 10 comprises a first rotating member in the form of a d-shaft subassembly or latching subassembly 22, a second rotating member in the form of a reset lever 20; a third rotating member in the form of a hammer 24; a first shaft in the form of the switch shaft 34; a second shaft in the form of a reset shaft 26; a hammer spring 28; a claw spring 27; a hammer claw or coupling member 30, and a closing solenoid 35. Directional references such as clockwise, counterclockwise, right, and left are used with reference to the component orientations depicted FIGS. 1-3 and 6-15.

Reset Lever 20

Figure 3:
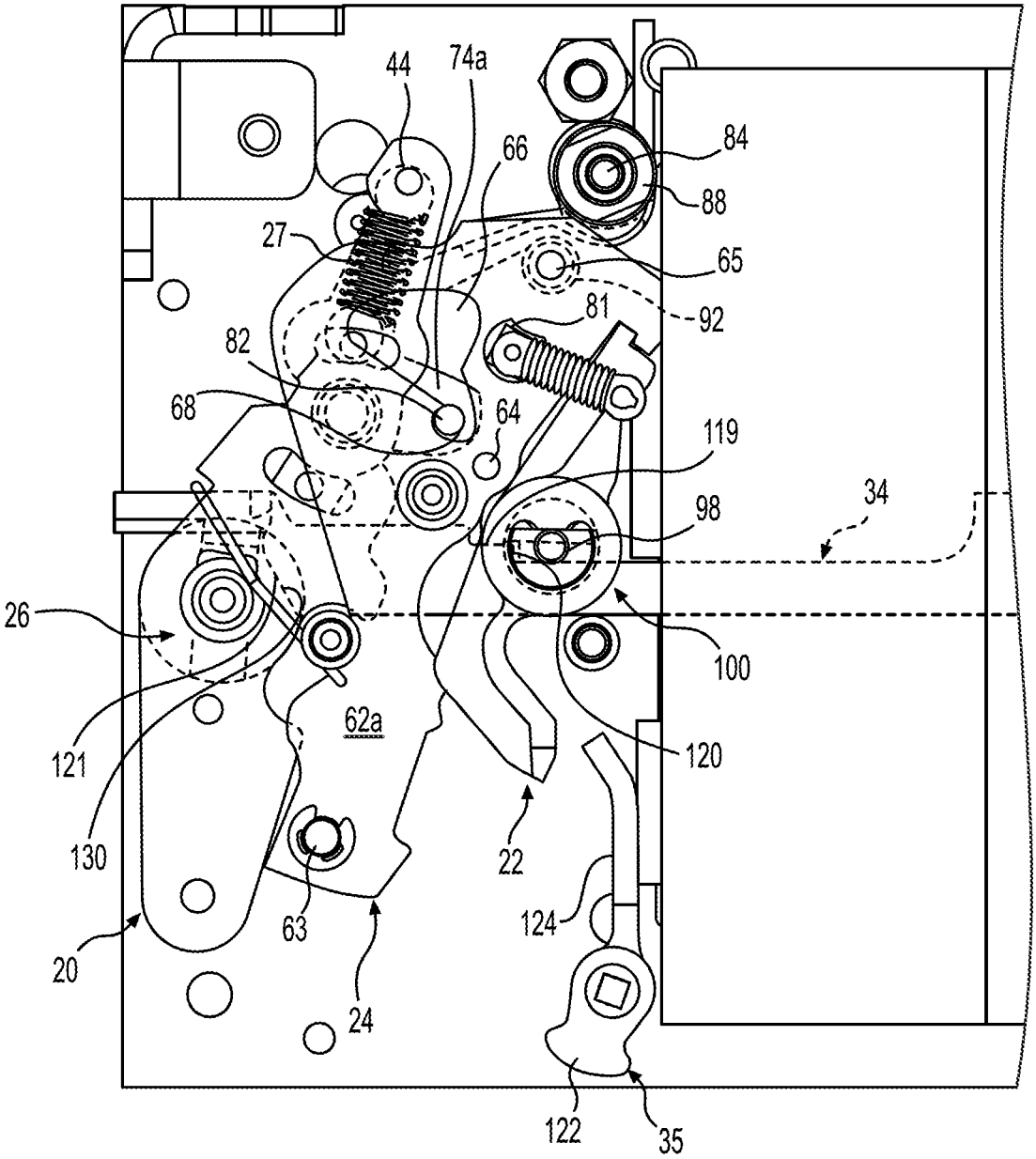
FIG. 3 is a magnified side view of the area designated "B" in FIG. 1, depicting certain components of the switch in phantom.
Figure 4:
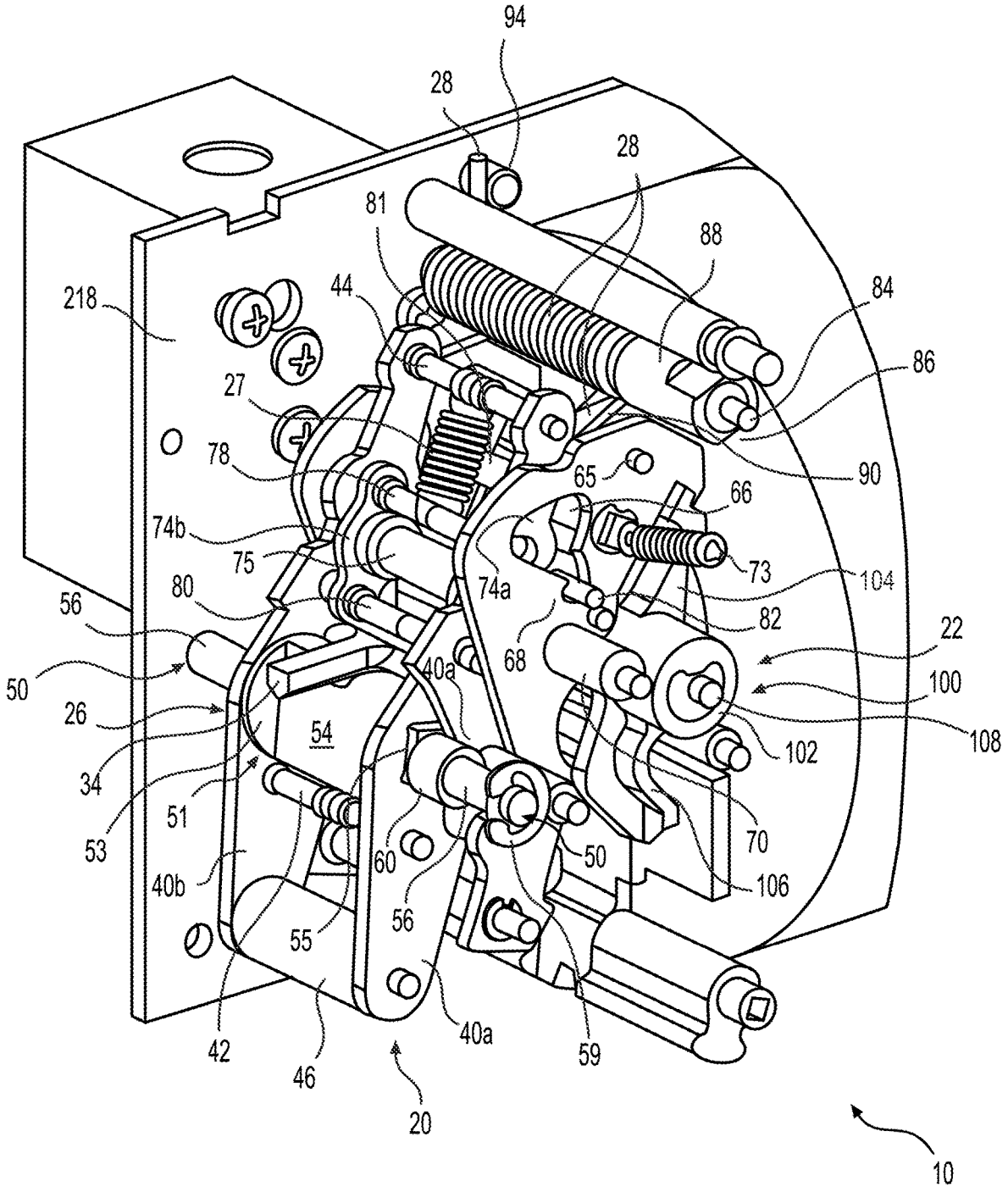
FIG. 4 is a magnified rear-perspective side view of the area designated "B" in FIG. 1.

Referring to FIGS. 3-5, the second rotating member, or reset lever 20, includes a first side member 40*a*, and a substantially identical second side member 40*b*. The first and second side members 40*a*, 40*b* are secured to each other, and are maintained in an opposing, spaced-apart relationship by a lower pin 42, an upper pin 44, and a balance weight 46, each of which is secured to the first and second side members 40*a*, 40*b* by riveting or other suitable means. The balance weight 46 is located at the bottom of the reset lever 20, and provides a counterbalancing effect that helps to prevent shock during fast opening of the switch 200 by the primary coil 212. Each of the first and second side members 40*a*, 40*a* has an arcuate first slot 47, and an arcuate second slot 48 formed therein as can be seen, for example, in FIGS. 5 and 9.

Reset Shaft 26

Referring again to FIGS. 3-5, the second shaft, or reset shaft 26, includes two end portions 50, and a center portion 51 disposed between the end portions 50. The center portion 51 includes two flanges 53, and a flat center member 54. The center member 54 adjoins, and is disposed between the flanges 53; and has a substantially planar surface 130. Each end portion 50 includes an inner member 55 having a substantially square cross-section; and an outer member 56 having a substantially circular cross section. Each inner member 55 extends through a substantially square hole formed a respective one of first and second side members 40*a*, 40*b* of the reset lever 20. The inner members 55 are sized to fit within the square openings with minimal clearance, so that the reset shaft 26 and the reset lever 20 rotate together.

Each outer member 56 extends through a substantially circular hole formed in a respective one of the sidewalls 218. The outer members 56 are sized to fit within the holes with minimal clearance, so that the resent shaft 26 and the attached reset lever 20 are suspended from, and can rotate in relation to the sidewalls 218.

The reset shaft 26 is restrained from lateral movement in relation to the sidewalls 218, i.e., movement in a direction coinciding with the axis of rotation of the reset shaft 26, by e-clips 59 that engage grooves formed in the outer members 56, as shown in FIG. 4. The reset shaft 26 can be restrained from lateral movement by other means in alternative embodiments. The reset lever 20 is restrained from lateral movement in relation to the reset shaft 26 by the flanges 53 of the reset shaft 26. The reset lever 20 is biased in the clockwise direction by a torsion spring 60 positioned on one of the outer members 56.

Hammer 24

Referring to FIGS. 3-5, the third rotating member, or hammer 24, includes a first side member 62*a*, and a substantially identical second side member 62*b*. The first and second side members 62*a*, 62*b* are secured to each other, and are maintained in an opposing, spaced-apart relationship by a lower pin 63, an intermediate pin 64, and an upper pin 65, each of which is secured to the first and second side member 62*a*, 62*b* by an interference fit or other suitable means. The hammer 24 also includes a cross-member 81. The cross member 81 extends between the first and second side members 62*a*, 62*b* as can be seen in FIG. 5, and has a substantially square cross section.

Figure 12:
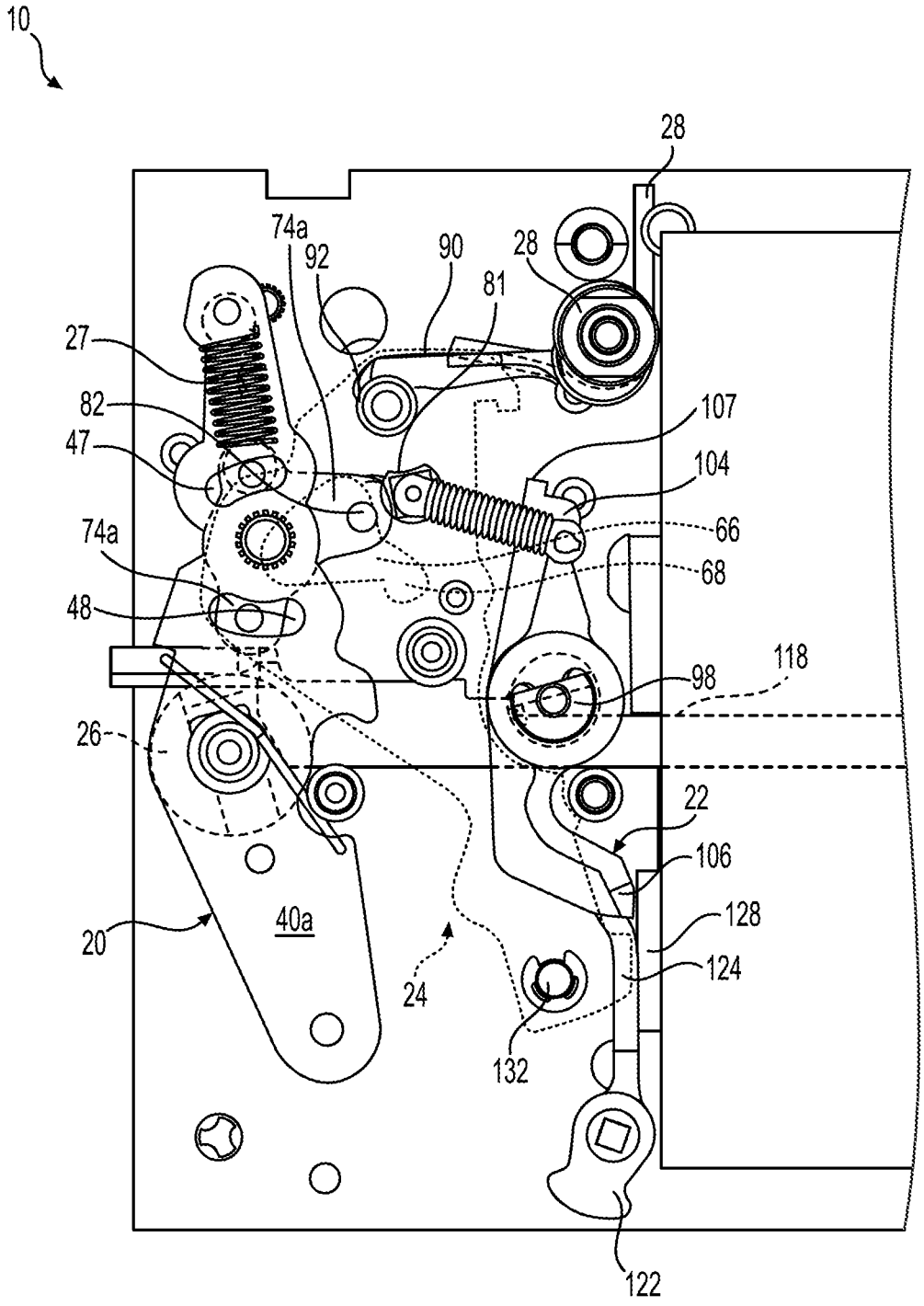
FIG. 12 is a view of the area depicting in FIGS. 3 and 6-11, showing the damper and latching assembly when the switch in the open state.

Each side member 62*a*, 62*b* has an opening 66 formed therein. The opening 66 includes a recessed area, or detent 68, as can be seen in FIGS. 4 and 12. Each of the side members 62*a*, 62*b* also has a notch 69 formed in a forward edge thereof, as can be seen in FIG. 12.

The hammer 24 is coupled to and suspended from the sidewalls 218 by a mounting pin 70. The mounting pin 70 is received in holes formed in the first and second side member 62*a*, 62*b*. The mounting pin 70 is sized to fit within the holes with minimal clearance, so that the hammer 24 can rotate on the mounting pin 70. The mounting pin 70 has reduced-diameter end portions 71, as can be seen in FIG. 4. Each end portion 71 extends through a hole formed in a respective one of the sidewalls 218. The end portions 71 are sized to fit within the holes with minimal clearance, so that the mounting pin 70 can rotate in relation to the sidewalls 218.

The hammer 24 is coupled to, and is biased for rotation toward the latching subassembly 22 by two extension springs 73 each connected to the cross member 81 of the hammer 24, and to a respective one of the upper arms 104 of the latching subassembly 22. The hammer 24 is balanced about its point of rotation to help prevent shock caused by the fast opening of the switch 200.

Coupling Member 30

Referring to FIGS. 3-6, the hammer claw, or coupling member 30, includes a first side member 74*a*, a substantially identical second side member 74*b*, and a mounting pin 75. The mounting pin 75 extends between the first and second side members 74*a*, 74*b*, and through holes formed in the respective first and second side members 74*a*, 74*b*. The holes are sized that mounting pin 75 fits within the holes with minimal clearance, allowing the first and second side members 74*a*, 74*b* to rotate freely in relation to the mounting pin 75. The respective ends of the mounting pin 75 are secured to the first and second side members 74*a*, 74*b* by welding or other suitable means. The coupling member 30 thus is suspended from, and can rotate in relation to the reset lever 20. As can be seen in FIG. 4, the mounting pin 75 includes shoulders that help to restrain the first and second side members 74*a*, 74*b* from lateral movement, i.e., from movement in a direction coinciding with the longitudinal axis of the mounting pin 75.

The coupling member 30 also includes a first pin 78, a substantially identical second pin 80, and a third pin or coupling pin 82, each of which extends between the first and second side members 74*a*, 74*b*. The respective ends of the first, second, and third pins 78, 80, 82 are positioned within holes formed in the first and second side members 74*a*, 74*b*. The holes are sized so that the ends of the first, second, and third pins 78, 80, 82 fit within the holes with minimal clearance, allowing the first, second, and third pins 78, 80, 82 to rotate freely in relation to the first and second side member 74*a*, 74*b*. The first, second, and third pins 78, 80, 82 have shoulders that restrain the first, second, and third pins 78, 80, 82 from lateral movement in relation to the first and second side members 74*a*, 74*b*.

The ends of the first pin 78 extend outward from the respective first and second side members 74*a*, 74*b*, and are disposed in the first slots 47 formed in the respective first and second side members 40*a*, 40*b* of the reset lever 20, as can be seen in FIG. 12. The ends of the second pin 80 likewise extend outward from the respective first and second side members 74*a*, 74*b*, and are disposed in the second slots 48 formed in the respective first and second side members 40*a*, 40*b*. The ends of the third pin 82 extend outward from the respective first and second side members 74*a*, 74*b*, and are disposed in the openings 66 formed in the respective first and second side members 62*a*, 62*b* of the hammer 24, as can be seen in FIG. 4.

The claw spring 27 is an extension spring, and is attached to the first pin 78, and the upper pin 44 of the reset lever 20, as can be seen in FIG. 4. Other types of springs can be used as the claw spring 27 in alternative embodiments.

Hammer Spring 28

Referring to FIGS. 3-5, the hammer spring 28 is a torsion spring, and is mounted on a pin 84 that extends between the sidewalls 218. The hammer spring 28 operates in conjunction with a cam 86. The cam 86 comprises a sleeve 88, and an arm 90 that adjoins the sleeve 88. The sleeve 88 is positioned over, and can rotate in relation to the pin 84 as shown in FIG. 3. The arm 90 is configured to engage a grooved roller 92 mounted for rotation on the upper pin 65 of the hammer 24. A first end of the hammer spring 28 engages a grooved stop 94 secured to one of the sidewalls 218 as shown in FIG. 4; and a second end of the hammer spring 28 engages the arm 90 so that the hammer spring 28 biases the hammer 24 in a counterclockwise direction.

Latching Subassembly 22

Referring to FIGS. 3-5, the first rotating member, or latching subassembly 22, comprises a third shaft in the form of a middle portion, or shaft 98; and two end portions 100. The shaft 98 has a substantially D-shaped cross section. The shaft 98 can be seen in FIG. 5. The shaft 98 is depicted in phantom in FIGS. 3 and 6-15. Each end portion 100 comprises a hub 102 that adjoins a respective end of the shaft 98. Each end portion 100 also includes an upper arm 104 and a lower arm 106 that adjoin the hub 102. The upper arms 104 each have a lip 107 on an upper end thereof.

Each of the end portions 100 also includes a cylindrical projection 108 that adjoins an outward-facing side of the associated hub 102, as can be seen in FIG. 4. Each projection 108 is received in a hole formed in a respective one of the sidewalls 218. The projections 108 are sized to fit within the holes 112 with minimal clearance, so that the latching subassembly 22 is suspended from, and can rotate in relation to the sidewalls 218. The latching subassembly 22 is configured to rotate between a first, or latching position shown in FIGS. 11-15, and a second, or releasing position shown in FIGS. 3, and 6-10.

The latching subassembly 22 is restricted from lateral movement, i.e., movement in a direction coinciding with the axis of rotation of the latching subassembly 22, by contact between the end portions 100 and the respective sidewalls 218.

Switch Shaft 34

As can be seen in FIG. 5, the first shaft, or switch shaft 34, has a forward portion 112, an intermediate portion 114 that adjoins the forward portion 114, and a rearward portion 116 that adjoins the intermediate portion 112. The intermediate portion 114 has an upward-facing first planar surface 118, and upward-facing second planar surface 119, and a step or lip 120 that adjoins first and second planar surfaces 118, 119. As can be seen in FIG. 3, the second planar surface 119 has a higher elevation than the first planar surface 118. The rearward portion 116 has a substantially planar, rearward-facing surface 121, as also can be seen in FIG. 5.

Closing Solenoid 35

As shown in FIG. 3, the closing solenoid 35 includes a solenoid 122, and an arm or paddle 124 connected to the solenoid 122. The solenoid 122 is configured to rotate the paddle 124 between a first, or opening position shown in FIG. 3, and a second, or closing position shown in FIG. 15. The paddle 124 is balanced about its point of rotation to help prevent shock caused by the fast opening of the switch 200.

Operation of the Assembly 10 During Opening of the Switch 200

The assembly 10 latches the switch shaft 34 in its open position, against the force of the closing spring assembly 207, by the engagement of the latching subassembly 22 and the switch shaft 34. During opening of the switch 200, the assembly 10 stores a portion of the energy imparted to the switch shaft 34 by the secondary coil 216. This energy storage dampens the movement of the switch shaft 34 and the attached moving contact 206, and helps to reduce the potential for the switch shaft 34 to rebound upon reaching its opening position. Such rebounding has the potential to cause the latching subassembly 22 to de-latch from the switch shaft 34, which in turn can result in the unintentional re-closing of the switch 200. The energy is stored in the hammer spring 28, and to a lesser extent, in the springs 73. The energy is used to unlatch the latching subassembly 22 from the switch shaft 34 during the subsequent re-closing of the switch 200.

Figure 6:
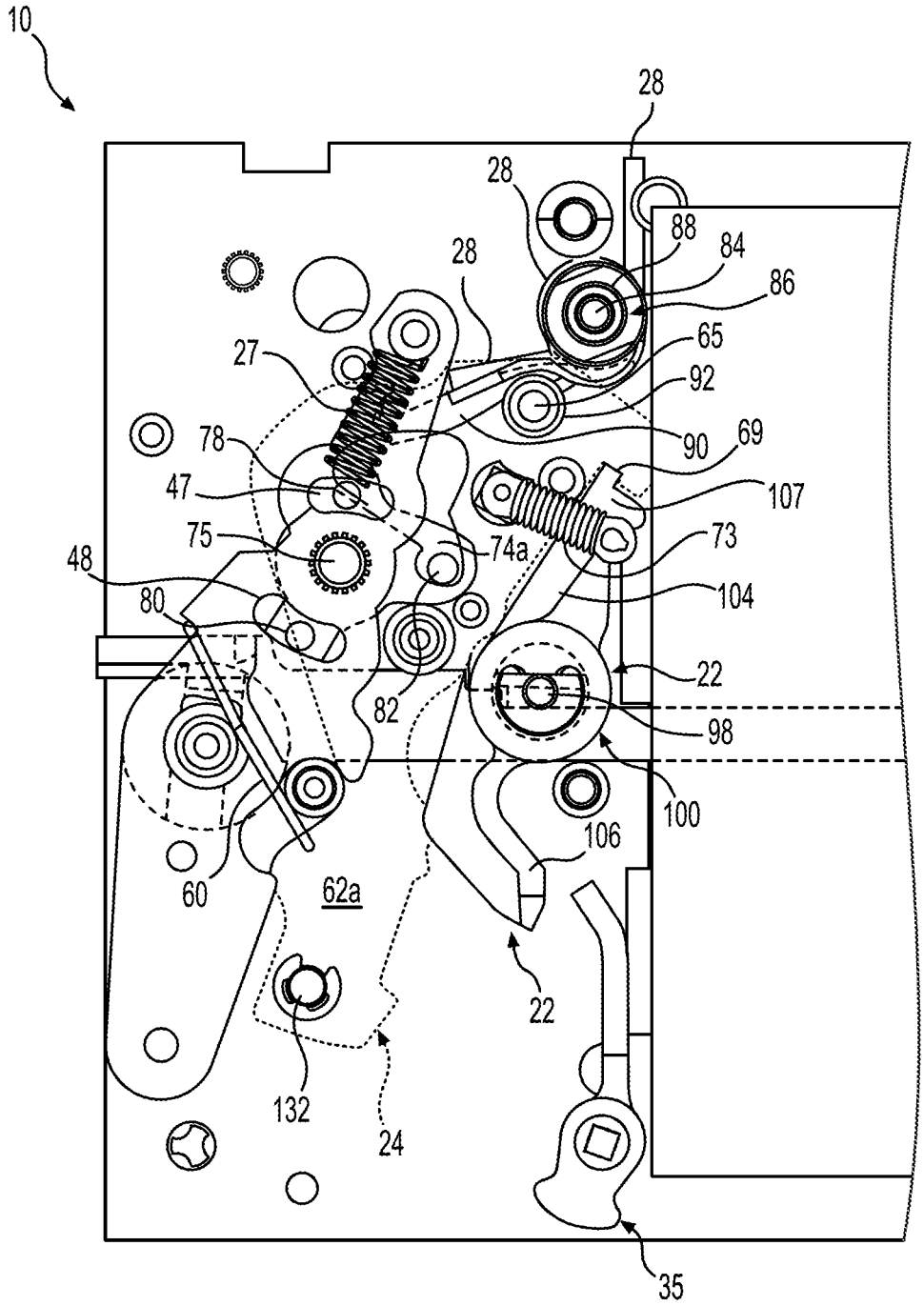
FIG. 6 is a view of the area depicted in FIG. 3, showing the damper and latching assembly when the switch in the closed state, and depicting additional components of the switch in phantom.

FIGS. 6 to 15 sequentially depict the damper and latching assembly 10 in various states during opening and closing of the switch 200. FIGS. 6 to 12 depict the assembly 10 as the switch 200 moves from its closed state to its open state. As depicted in FIG. 6, the switch 200 is fully closed. The switch shaft 34 is in its forward most, or closing position, so that electrical and mechanical contact can occur between the moving contact 204 and the stationary contact 206. The latching subassembly 22 is in its most clockwise, or unlatched position. As can be seen in FIG. 6, the shaft 98 of the latching subassembly 22 is contacting the second planar surface 119 of the switch shaft 34, preventing counterclockwise rotation of the shaft 98; and the shaft 98 is not interfering with the linear movement of the switch shaft 34 toward or away from its closing position. Also, the rearward portion 116 of the switch shaft 34 is not yet contacting the reset shaft 26.

As also can be seen in FIG. 6, the reset lever 20 and the hammer 24 are in their most clockwise positions. Each of the lips 107 on the upper arms 104 of the latching assembly 122 is positioned within an associated one of the notches 69 in the hammer 24. The lower end of the hammer spring 28 is in its most counterclockwise position, so that the winding of the hammer spring 28 is at its minimum. Although the hammer spring 28 is in a state of minimal energy storage, the hammer spring 28 nevertheless exerts a force on the hammer 24 by way of the roller 92. At this point, the force exerted by the hammer spring 28 is biasing the hammer 24 in the clockwise direction.

Referring further to in FIG. 6, the spring 60 is forcing spring 27 to be slightly tensioned, so that the claw spring 27 exerts a slight clockwise rotation on the coupling member 30. This tension causes the third pin 82 of the coupling member 30 to be disposed within the detents 68 in the first and second side members 62*a*, 62*b* of the hammer 24, so that the hammer 24 is coupled to the reset lever 20 by way of the coupling member 30. Each end of the first pin 78 is positioned at a first end of its associated first slot 47 in the first and second side members 40*a*, 40*b* of the reset lever 20. Each end of the second pin 80 likewise is positioned at a first end of its associated second slot 48.

Figure 7:
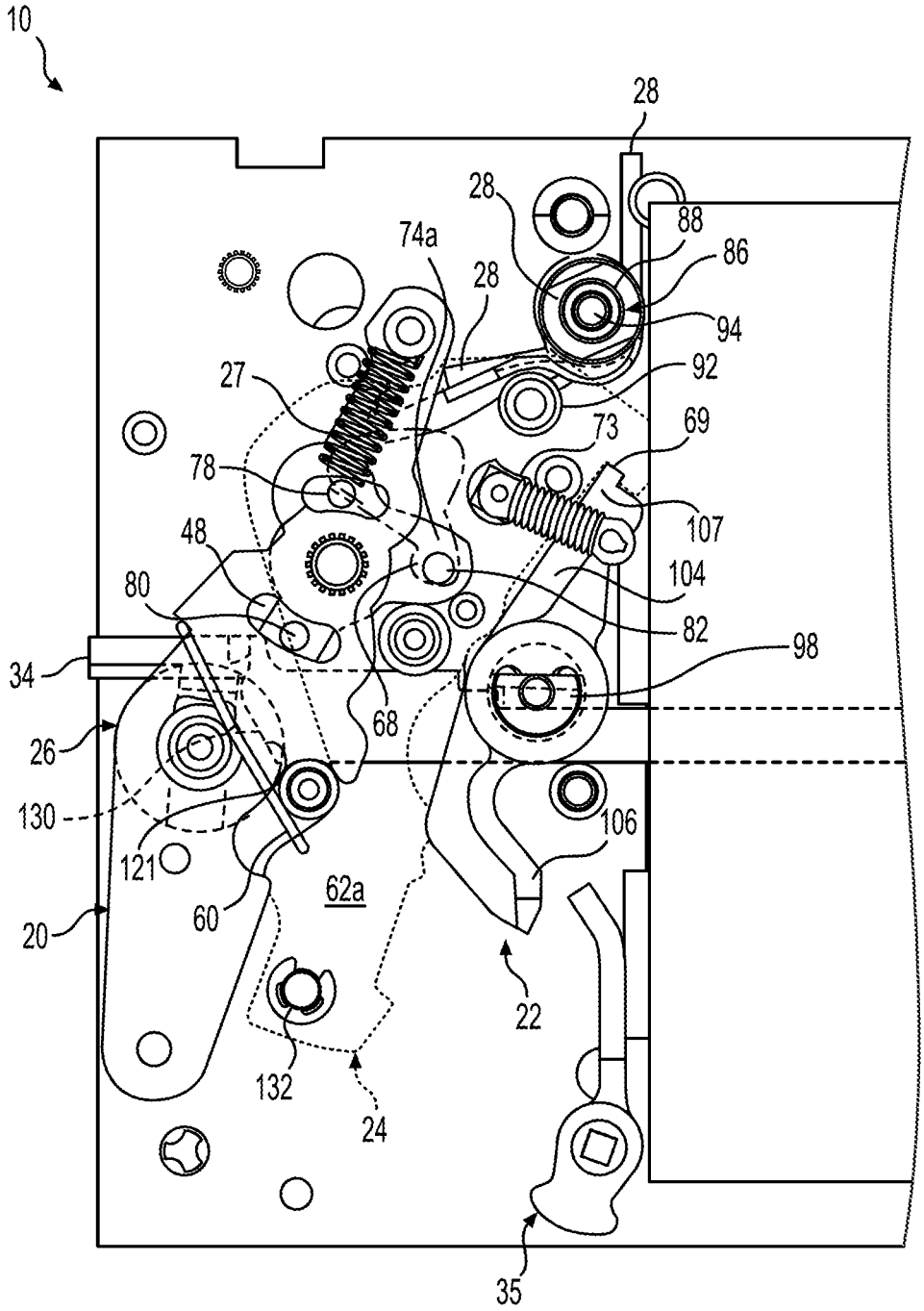
FIGS. 7-11 are views of the area depicted in FIGS. 3 and 6, showing the damper and latching assembly sequentially as the switch moves from the closed state and toward the open state.

Referring to FIG. 7, the switch 200 has begun its opening sequence. The switch shaft 34 has been moved to the left, from its closing position, by the secondary coil 216 during the slow-opening sequence of the switch 200, or by the primary coil 212 during fast-opening sequence. The movement of the switch shaft 34 has caused the moving contact 204 to separate from the stationary contact 206, thereby interrupting the flow of electric current through the switch 200. The rearward-facing surface 121 of the switch shaft 34 has contacted the surface 130 of the center member 54 of the reset shaft 26, and has imparted a counterclockwise rotation to the rest shaft 26 and the attached reset lever 20. As can be seen in FIG. 7, the surface 121 of the switch shaft 34 is relatively large, and is angled to match the orientation of the surface 130 of the center member 54. These features help to prevent deformation of the switch shaft 34 that otherwise could result from repeated openings of the switch 200.

The switch shaft 34 initially moves to the left, from its closing position, by a distance of approximately one millimeter before the switch shaft 34 contacts the rest shaft 26. This amount of movement is sufficient to permit the moving contact 204 and the stationary contact 206 to separate sufficiently to interrupt the flow of electric current through the switch 200. Thus, because the switch shaft 34 does not contact any part of the damper and latching assembly 10 prior to separation of the moving and stationary contacts 204, 206, the assembly 10 does not increase the time needed to separate the moving and stationary contacts 204, 206.

In further reference to FIG. 7, the rotation of the reset lever 20, in conjunction with the restraining effect of the hammer 24 on the third pin 82 of the coupling member 30, has caused the coupling member 30 to rotate in a clockwise direction in relation to the reset lever 20. The rotation of the coupling member 30, in turn, causes the first and second pins 78, 80 to move away from the first ends of the respective first and second slots 47, 48 in the reset lever 20.

Figure 8:
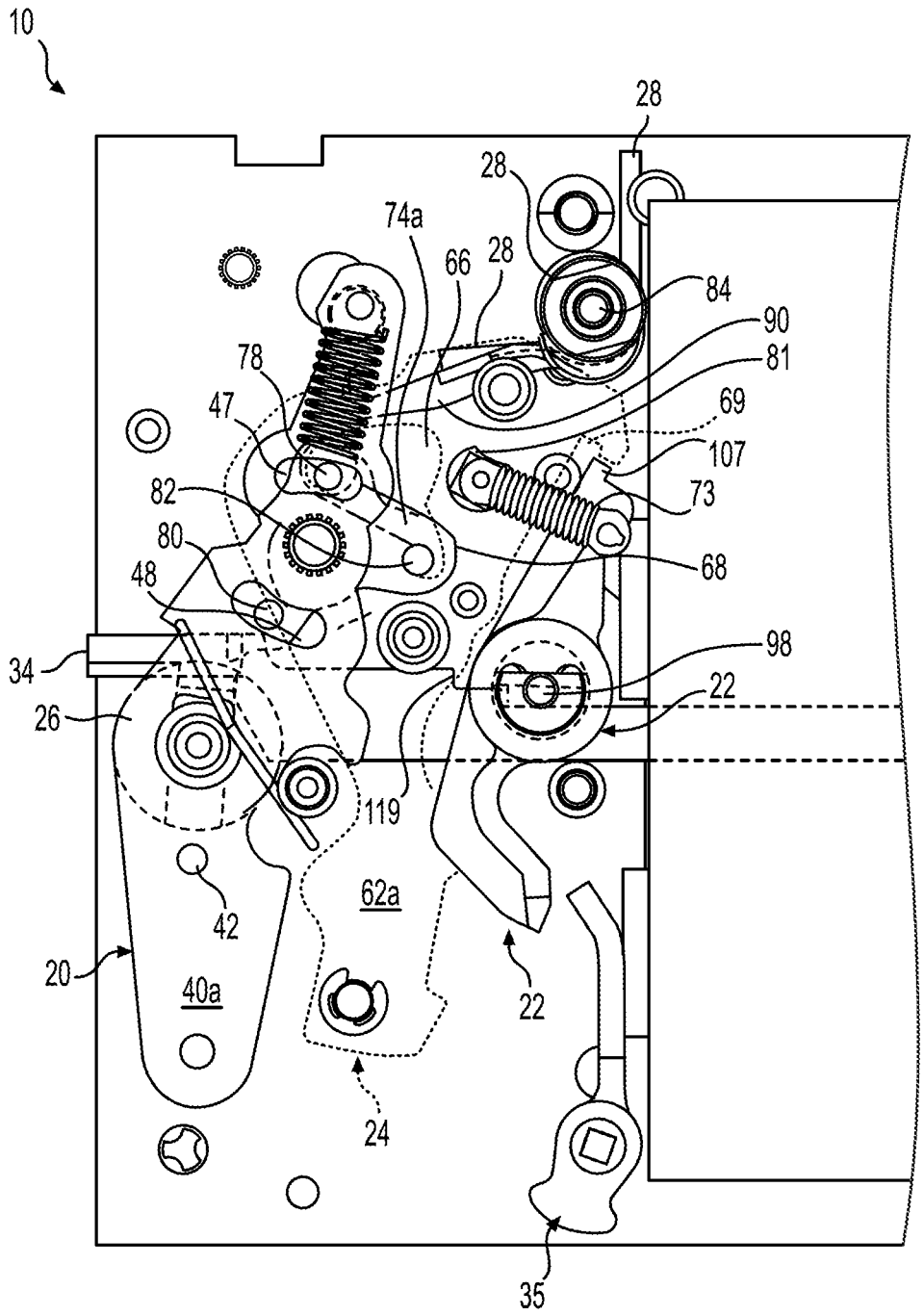

Referring to FIG. 8, as the opening of the switch 200 progresses, the switch shaft 34 has moved further to the left, toward its opening position, imparting further counterclockwise rotation to the reset shaft 26 and the attached reset lever 20. The reset lever 20 has imparted a counterclockwise rotation to the hammer 24 by way of the third pin 82 of the coupling member 30, which has remained in the detents 68 and thus continues to couple the hammer 24 and the reset lever 20 by way of the coupling member 30. Also, the coupling member 30 has continued to rotate in a clockwise direction in relation to the reset lever 20, which in turn causes the first and second pins 78, 80 to move further away from the first ends of the respective first and second slots 47, 48 in the reset lever 20.

In further reference to FIG. 8, the counterclockwise rotation of the hammer 24 has caused the arm 90 of the cam 86 and the lower end of the hammer spring 28 to rotate in a clockwise direction, winding the hammer spring 28. The resistance of the hammer spring 28 to being wound dampens the rearward movement of the switch shaft 34. Also, the energy being transferred to the hammer spring 28 as it is wound is stored in the hammer spring 28, and as discussed below, is used to help unlatch the latching subassembly 22 from the switch shaft 34 when the switch 200 subsequently is re-closed. The counterclockwise rotation of the hammer 24 also has caused the springs 73 to stretch. The resistance of the springs 73 to being stretched exerts a further damping effect on the rearward movement of the switch shaft 34. In addition, the counterclockwise rotation of the hammer 24 has caused the lips 107 of the hammer 24 to impart a counterclockwise rotation to the latching subassembly 22, before the lips 107 disengage from the latching subassembly 22 at shown in FIG. 8. Also, it should be noted that the respective moment arms through which the opening force on the switch shaft 34 acts on the reset lever 20 and the hammer 26 during the opening sequence are relatively small. Thus, a substantial portion of the opening force is transmitted to, and dissipated in the sidewalls 218 of the switch 200 by way of the outer members 56 of the rest shaft 26, and the mounting pin 70 of the hammer 24, instead of being turned into torque.

Figure 9:
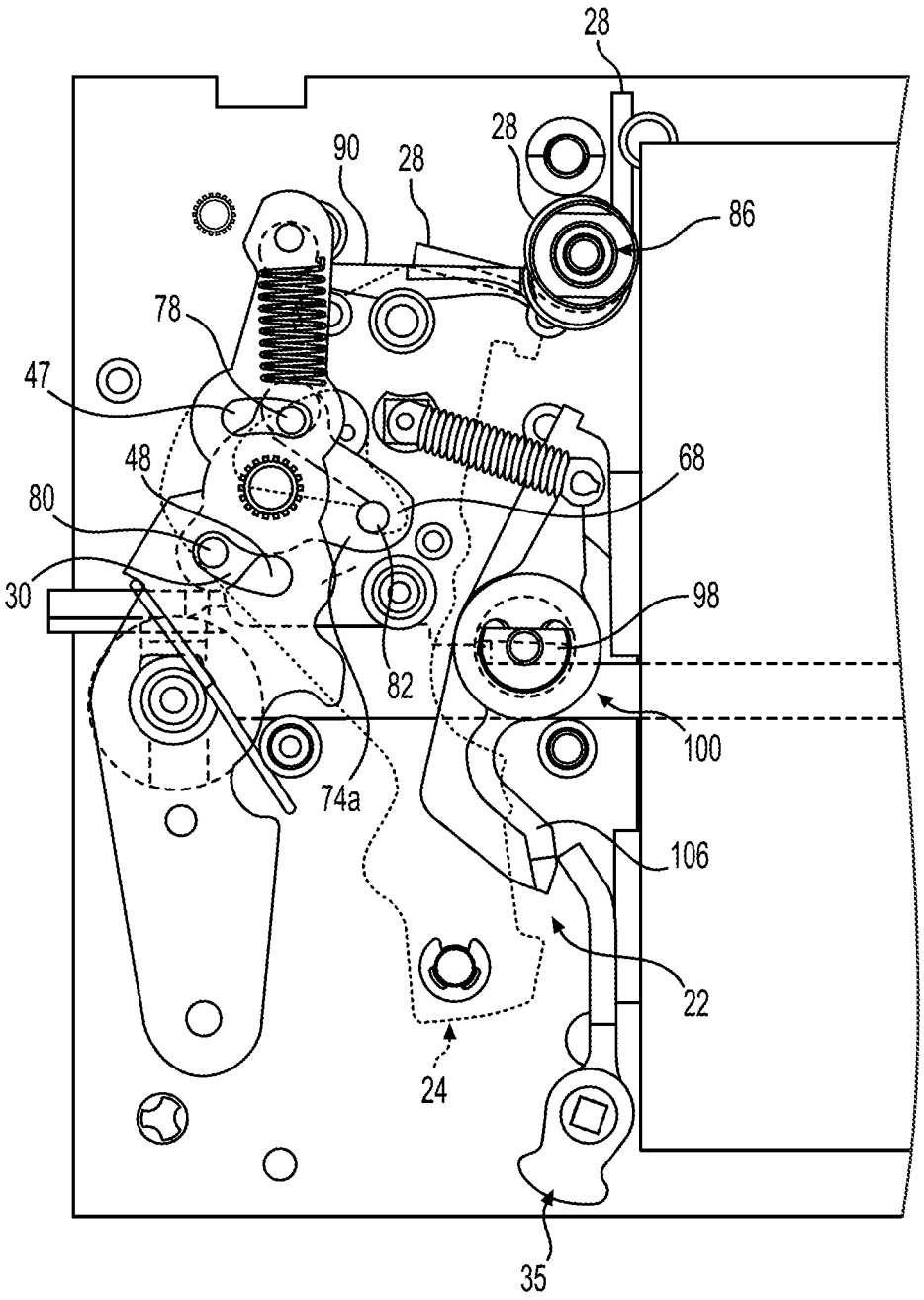

As depicted in FIG. 9, the switch shaft 34 has advanced further toward is opening position as the opening of the switch 200 progresses, imparting further counterclockwise rotation to the latching subassembly 22 and the attached reset lever 20. The voltage pulse that energizes the secondary coil 216 can be controlled so that, at about this point in the opening sequence, the force exerted by the secondary coil 216 to gradually decreases throughout the remainder of the opening sequence. This feature helps to slow the switch shaft 34 and reduce rebounding of the switch shaft 34 as the switch shaft 34 subsequently reaches the end of its leftward travel.

In further reference to FIG. 9, the reset lever 20 has imparted additional counterclockwise rotation to the hammer 24 by way of the third pin 82 of the coupling member 30, which in turn has caused the first and second pins 78, 80 to approach the second ends of the respective first and second slots 47, 48 in the reset lever 20. Also, the continued counterclockwise rotation of the hammer 24 has resulted in further winding of the hammer spring 28, which has transferred additional energy to the hammer spring 28. Also, the energy transfer to the spring 28 has continued to dampen the movement of the switch shaft 34 toward its opening position.

In further reference to FIG. 9, the first and second side members 62*a*, 62*b* of the hammer 24 have moved closer to the respective lower arms 106 of the latching subassembly 22. Also, the leftward movement of the switch shaft 34 has positioned the relatively low first surface 118 of the switch shaft 34 directly below the shaft 98 the latching subassembly 22, so that the switch shaft 34 no longer prevents rotation of the latching subassembly 22 in the counterclockwise direction, toward its latching position.

Figure 10:
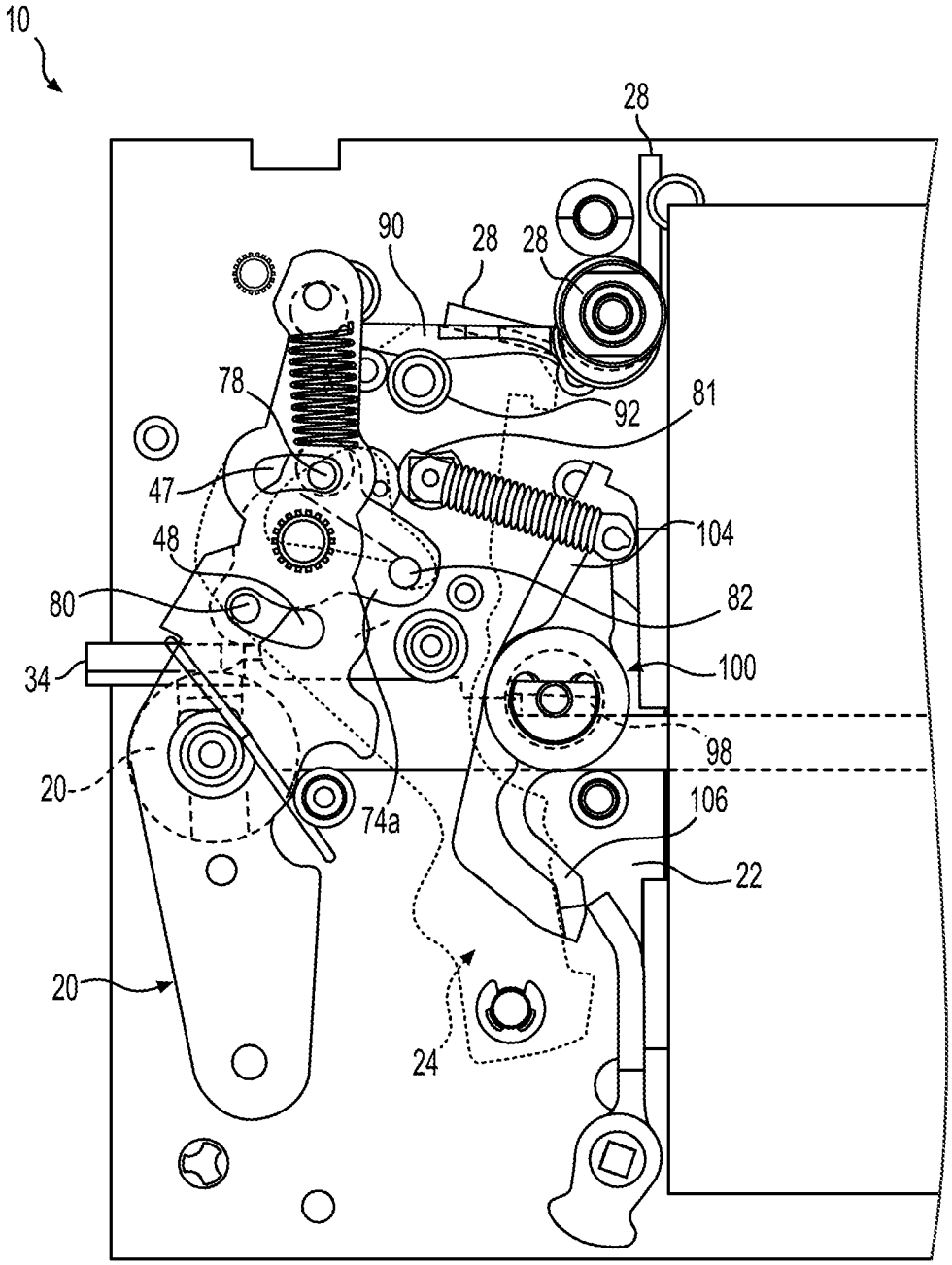

Referring to FIG. 10, the continued movement of the rest shaft 34 toward its opening position has caused the reset lever 20 impart additional counterclockwise rotation to the hammer 24 by way of the third pin 82 of the coupling member 30. The rotation of the hammer 24 has caused the point of contact between the lower end of the hammer spring 28 and the roller 92 of the hammer 24 to move to an over-center over-toggle position in relation to the point of rotation of the hammer 24, i.e., the point of contact between the hammer spring 28 and the hammer 24 now is located leftward of the axial centerline of the mounting pin 70 on which the first and second side members 62*a*, 62*b* rotate. Thus, the reactive force exerted by the hammer spring 28 on the hammer 24 now produces a counterclockwise moment on the hammer 24, causing the hammer 24 to rotate toward its most counterclockwise angular position.

As further depicted in FIG. 10, the first and second pins 78, 80 have reached the second ends of the respective first and second slots 47, 48 in the reset lever 20. At this point, further counterclockwise rotation of the reset lever 20 will cause the third pin 82 to begin disengaging from the coupling member 30. Also, the lower ends of the first and second side members 62*a*, 62*b* of the hammer 24, and the lower arms 106 of the latching subassembly 22 have contacted each other. Thus, further counterclockwise rotation of the hammer 24 will impart a counterclockwise rotation to the latching subassembly 22.

Figure 11:
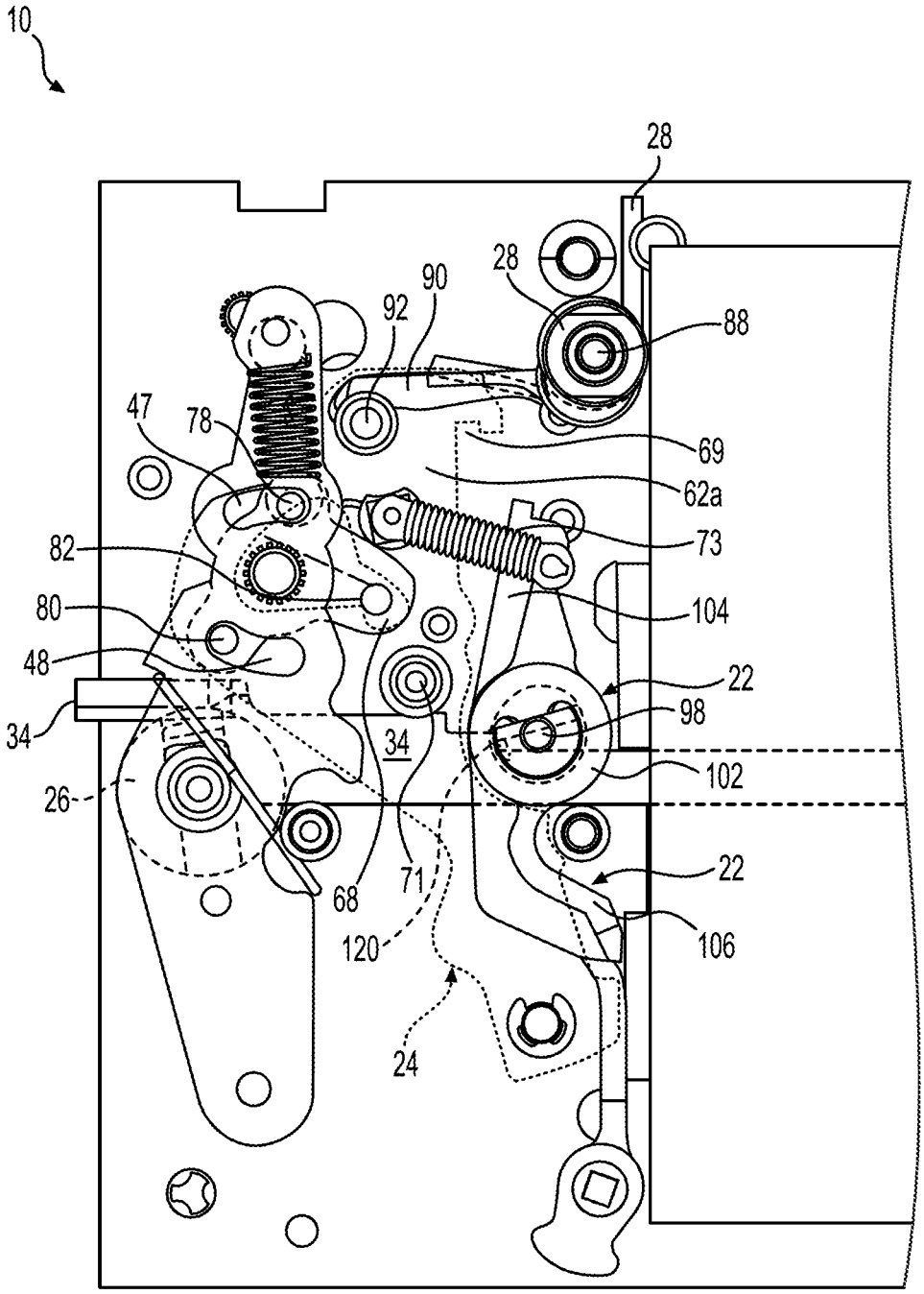

Referring to FIG. 11, the switch shaft 34 is approaching the maximum extent of its leftward travel. The additional rotation imparted by the switch shaft 34 to the reset lever 20, in conjunction with the now counterclockwise bias of the hammer spring 28 on the hammer 24, have driven the hammer 28 to its most counterclockwise position. The rotation of the hammer 24, in turn, has rotated the latching subassembly 22 counterclockwise, into its latching position.

As can be seen in FIG. 11, the lower ends of the first and second side members 62*a*, 62*b* of the hammer 24, and the lower arms 106 of the latching subassembly 22 are restrained from further rotation by resilient bumpers 128 mounted on an adjacent stationary portion of the switch 200. The bumpers 128 can be formed of viton or other suitable materials, and help to reduce or eliminate rebounding of the hammer 24 and the latching subassembly 22 as the hammer 24 and the latching subassembly 22 reach the ends of their respective counterclockwise rotation.

Referring further to FIG. 11, the springs 73 have been stretched to their maximum state of extension. The resulting force exerted by the springs 73 on the latching subassembly 22 further helps to reduce rebounding of the latching subassembly 22 as the latching subassembly 22 reaches the end of its counterclockwise rotation.

As also can be seen in FIG. 11, the continued rotation of the reset lever 20 after the hammer 24 has been stopped by the bumpers 128 causes the third pin 82 to begin to be drawn out of the detents 68 in the hammer 24.

As depicted in FIG. 12, the switch 200 has reached the fully open and latched state. The latching subassembly 22 is in its latching position, and the secondary coil 216, which has been deactivated, no longer exerts a leftward force on the switch shaft 34. Upon deactivation of the secondary coil 216, the switch shaft 34 has moved slightly to the right, into the opening position of the switch shaft 34, due to the rightward bias of the closing spring assembly 207. The switch shaft 34 is being restrained from further movement to the right by interference between the shaft 98 of the latching subassembly 22, and the step 120 of the switch shaft 34. The energy that has been stored in the hammer spring 28, and to a lesser extent, the springs 73, maintains the latching subassembly 22 securely in its latching position; and as discussed below, is subsequently used to assist in the opening of the switch 200.

As also can be seen in FIG. 12, the third pin 82 of the coupling member 30 has been drawn out of the detents 68 in the hammer 24 by the rotation of the rest lever 20. The reset lever 20 and the coupling member 30 thereby are decoupled from the hammer 24, so that the switch 200 subsequently can close as described below. The coupling member 30 has come to rest on the cross member 81 of the hammer 24, which restrains the coupling member 30 from further counterclockwise rotation. The tension exerted by the claw spring 27 on the coupling member 30 maintains the coupling member 30 in the orientation, relative to the reset lever 20, depicted in FIG. 12, helping to ensure that the coupling member 30 does not prematurely re-engage with the hammer 24 and interfere with the subsequent closing of the switch 200 as discussed below.

Operation of the Assembly 10 During Closing of the Switch 200

Figure 13:
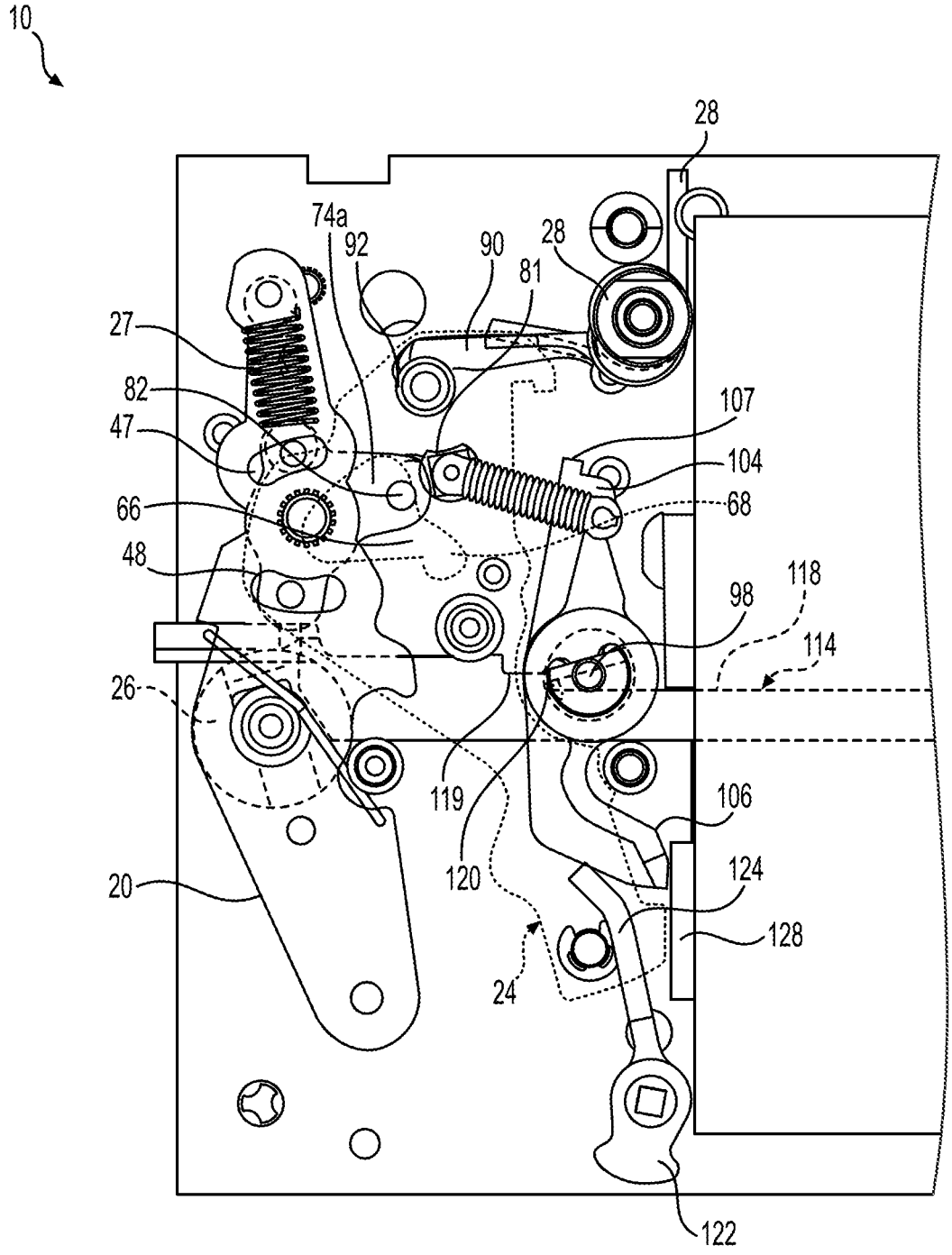
FIGS. 13-15 are views of the area depicting in FIGS. 3 and 6-12, depicting the damper and latching assembly sequentially as the switch moves from the open state and toward the closed state.
Figure 14:
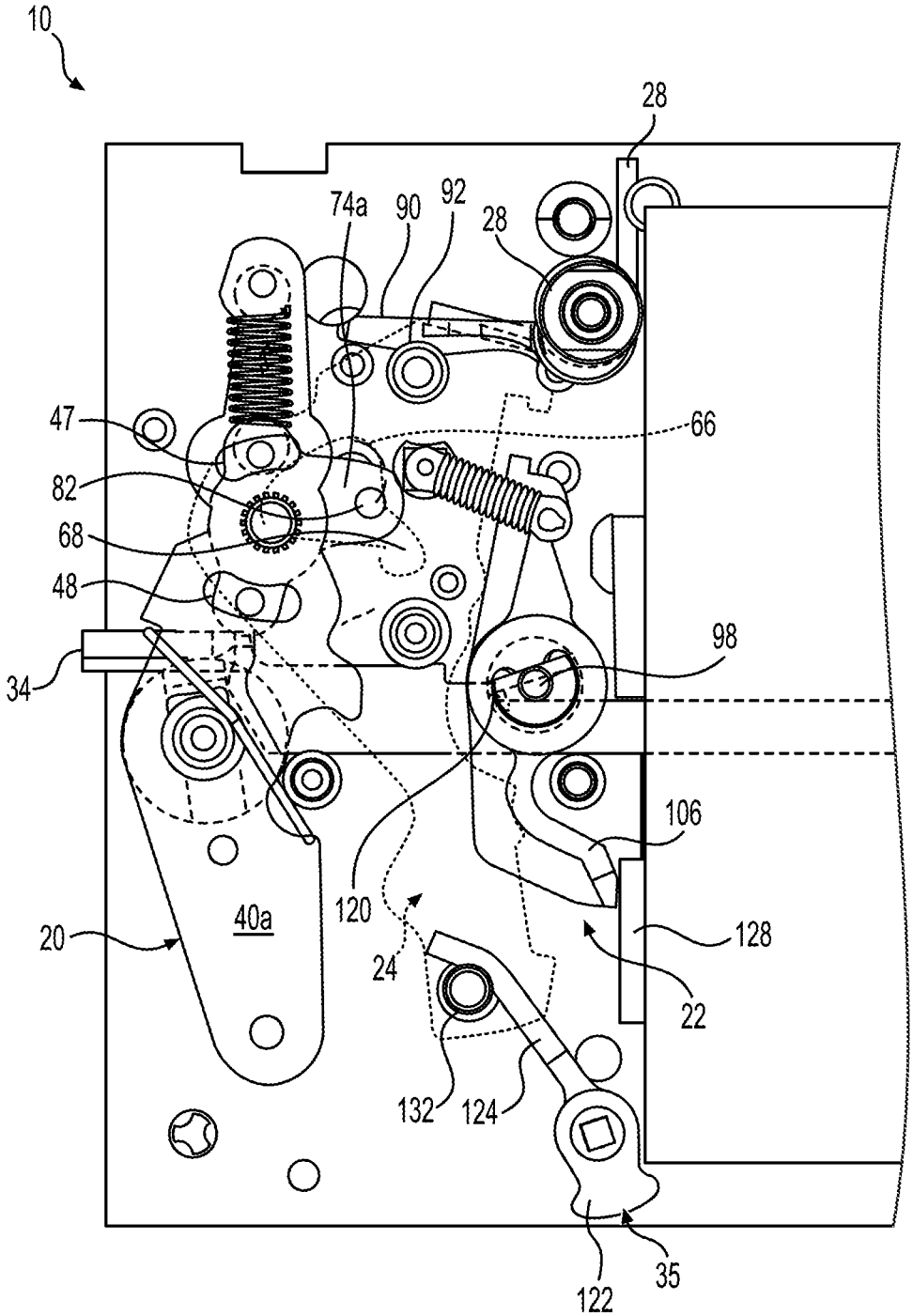
Figure 15:
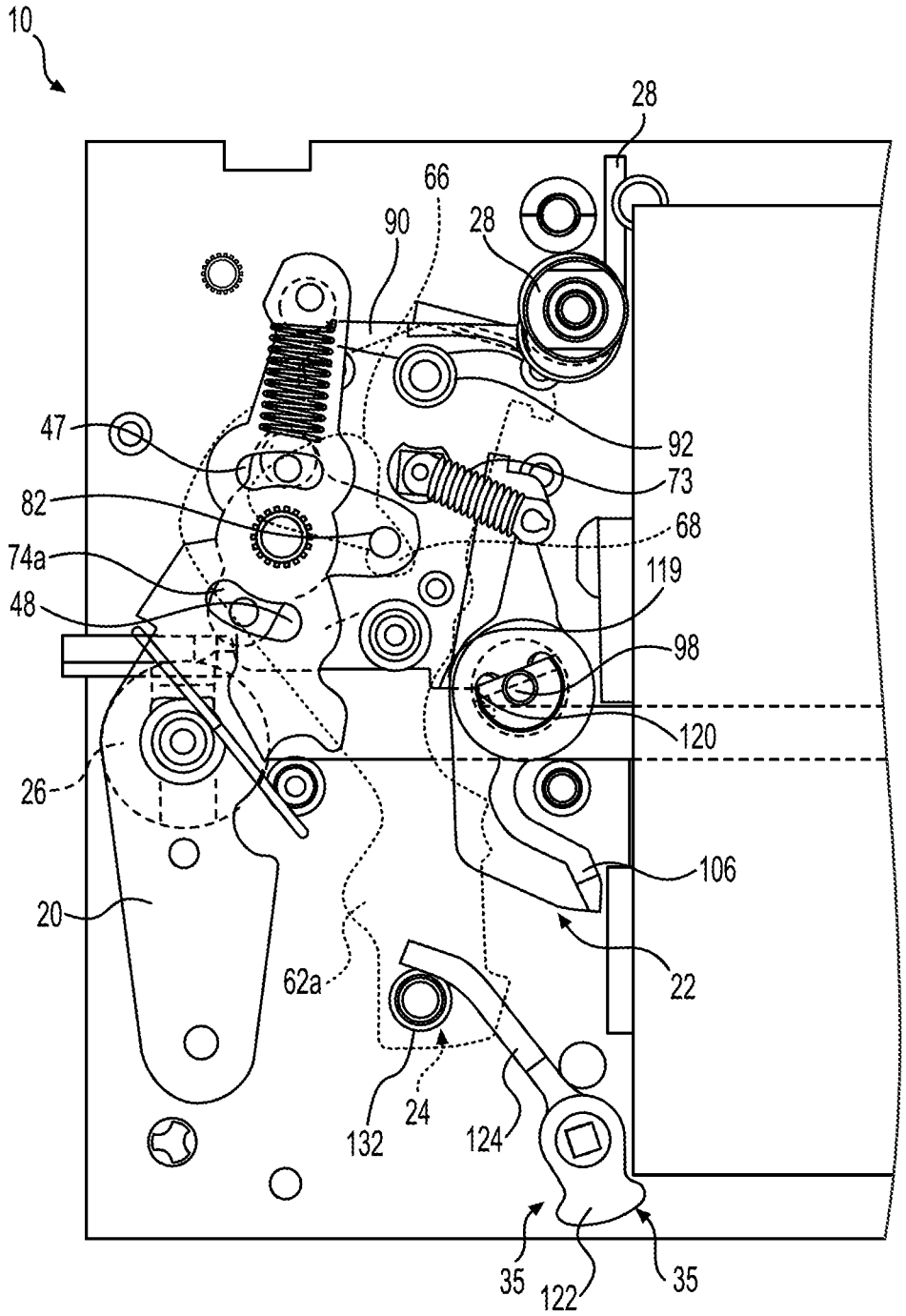

FIGS. 13 to 15 illustrate the assembly 10 during closing of the switch 200. FIG. 6 depicts the switch 200 in its closed state. FIG. 13 shows the assembly 10 at the start of the closing process. The closing solenoid 35 is activated at the start of the closing process, causing the solenoid 122 to rotate the paddle 124 in a counterclockwise direction, away from its closing position. As depicted in FIG. 13, the paddle 124 has contacted a pin 132 on the first side member 62*a* of the hammer 24, and is about to initiate rotation of the hammer 24 in the clockwise direction.

Referring further to FIG. 13, the third pin 82 of the coupling member 30 is located within the relatively large openings 66 in the first and second side members 62*a*, 62*b* of the hammer 24, and outside of the detents 68 in the first and second side members 62*a*, 62*b*. Also, the tension exerted by the claw spring 27 on the coupling member 30 maintains the coupling member 30 in the orientation, relative to the reset lever 20, depicted in FIG. 13, helping to ensure that the third pin 82 remains outside of the detents 68 until the final stage of the closing sequence. Thus, the hammer 24 is decoupled from the reset lever 20, which is restrained from clockwise rotation by the latched switch shaft 34. The hammer 24, therefore, can rotate in the clockwise direction under the bias of the paddle 124, without any constraint from the reset lever 20, which in turn facilitates the unlatching of the switch shaft 34 as discussed below As also can be seen in FIG. 13, the point of contact between the hammer spring 28 and the hammer 24 is still in an over-center position in relation to the point of rotation of the hammer 24. Thus, the hammer spring 28 is still exerting a counterclockwise moment on the hammer 24.

In further reference to FIG. 13, the secondary coil 216 has been activated with a low voltage pulse to move the switch shaft 34 slightly to the left, eliminating contact between the switch shaft 34 and the latching subassembly 22, which in turn permits the latching subassembly 22 to rotate easily. Due to the bias of the closing spring assembly 207, the force exerted by the switch shaft 34 on the latching subassembly 22 is relatively high, e.g., about 140 pounds. Providing a low-voltage pulse to the secondary coil 216 to momentarily decouple the switch shaft 34 from the latching subassembly 22 at the start of the closing sequence thus eliminates the high frictional force between the switch shaft 34 and the latching subassembly 22 that otherwise would need to be overcome by the closing solenoid 35 during the de-latching of the switch shaft 34.

Referring to FIG. 14, the continued counterclockwise rotation of the paddle 124 has imparted a clockwise rotation to the hammer 24. At this point, the rotation of the hammer 24 has caused the point of contact between the hammer spring 28 and the hammer 24 to move back from its over-center position, i.e., the point of contact between the hammer spring 28 and the hammer 24 now is located to the right of the axial centerline of the mounting pin 70. Thus, the stored energy of the hammer spring 28 is now producing a clockwise moment on the hammer 24.

In further reference to FIG. 14, the latching subassembly 22 is about to begin rotating from its latching position to its unlatching position. In particular, the rotation of the hammer 24 is about to cause the first and second side members 62*a*, 62*b* of the hammer 24 to contact the upper arms 104 of the latching subassembly 22. Further clockwise rotation of the hammer 24 after this point thus imparts a corresponding clockwise rotation to the latching subassembly 22, causing the latching subassembly 22 to rotate away from its latching position. Because the hammer spring 28 now is exerting a clockwise moment on the hammer 24, and the hammer 24 is moving the latching subassembly 22 away from its latching position, using the energy that was stored in the hammer spring 28 during the opening of the switch 200. Thus, the closing solenoid 35 only needs to rotate the hammer 24 back to its over-center position, after which the stored energy of the hammer spring 28 provide most, or all the force needed to complete the unlatching of the switch shaft 34. The closing solenoid 35, therefore, can be relatively small, helping to reduce the overall dimensions of the damper and latching assembly 10 and permitting the assembly 10 to fit within the very limited space constrains within the switch 10.

As also can be seen in FIG. 14, the clockwise rotation of the hammer 24 in relation to the latching subassembly 22 has reduced the stretching of the springs 73, thereby reducing the counterclockwise moment being exerted by the springs 73 on the latching subassembly 22, which in turn makes it easier to rotate the latching subassembly 22 to its unlatching position. Also, the energy previously stored in the springs 73 resulted in a clockwise moment the hammer 24, thus providing a limited degree of assistance in rotating the hammer 24 to the angular position shown in FIG. 4.

The energy stored in the springs 73 and the hammer spring 28 and being used in the unlatching process of the latching subassembly 22 is the energy that was transferred to the springs 73 and the hammer spring 28 during the opening of the switch 200. As explained above, this energy transfer had dampened the movement of the switch shaft 34 and the moving contact 204 as the switch shaft 34 moved toward its opening position. The energy transfer to and from the springs 73 and the hammer spring 28 thus provides benefits during both the opening and the closing of the switch 200. (It should be noted that the energy stored in the springs 73, and the force exerted by the springs 73 to help close the switch 200, are relatively low. The energy storage occurs primarily in the hammer spring 28, and the force that assists in the closing the switch 200 results primarily from the energy stored in the hammer spring 28.)

In further reference to FIG. 14, the secondary coil 216 remains activated at this point, and has driven the switch shaft 34 into contact with the center portion 52 of the reset shaft 26. This contact prevents the reset shaft 26 and the reset lever 20 from rotating in the clockwise direction, which in turn helps to ensure that the third pin 82 remains disengaged from the hammer 24 and does not interfere with the clockwise rotation of the hammer 24.

Referring to FIG. 15, the continued counterclockwise rotation of the paddle 124 of the closing solenoid 35 has caused the paddle 124 to reach its opening position, i.e., paddle 124 has reached the full extent of its counterclockwise rotation. The closing solenoid 35 is deactivated at this point. The hammer spring 28, which continues to exert a clockwise moment on the hammer 24, is now the sole driver of the clockwise rotation of the hammer 24 and the latching subassembly 22. The switch shaft 34 continues to be driven to the right, from its locking position, by the secondary coil 216, thereby maintaining a slight gap between the switch shaft 34 and the shaft 98 of the latching subassembly 22 so that the latching subassembly 22 can rotate without interference caused by friction between the switch shaft 34 and the shaft 98.

As depicted in FIG. 6, the continued rotation of the hammer 24 under the bias of the hammer spring 28 has rotated the latching subassembly 22 to it unlatching position. The moment arm between the axis of rotation of the hammer 24 and the point at which the force of the hammer spring 28 is applied to the hammer 24 is the largest at this point, helping to ensure that the latching subassembly 22 is rotated fully to its unlatching position. Also, the secondary coil 216 has been deactivated, which has allowed unlatched switch shaft 34 to move to its closing position under the bias of the closing spring assembly 207, thus re-establishing contact between the moving contact 204 and the stationary contact 206. Also, the movement of the switch shaft 34 to its closing position has allowed the reset lever 26 to rotate clockwise under the bias of the spring 60, which in turn has caused the third pin 82 of the coupling member 30 to re-enter the detents 68 in the first and second side members 62*a*, 62*b* the hammer 24 so that the reset lever 20 and the hammer 24 are again coupled for rotation together.

In further reference to FIG. 6, the springs 73 no longer are extended, and are not exerting any substantial tension on the hammer 24 and the latching subassembly 22. Each lip 107 of the latching subassembly 22 has re-entered its associated notch 69 in the hammer 24. And the paddle 124 of the closing solenoid 35 has returned to its closing position. The assembly 10 thus is ready for the subsequent re-opening of the switch 200.

PARTS LIST

Damper and Latching System 10
Reset lever 20
Latching assembly 22
Hammer 24
Reset shaft 26
Hammer spring 28
Claw spring 27
Coupling member 30
Switch shaft 34
Closing solenoid 35
First side member 40*a*
Second side member 40*b*
Lower pin 42
Upper pin 44
Balance weight 46
Slot 47
Slot 48
End portions 50
Center portion 51
Flanges 53
Center member 54
Inner member 55
Outer member 56
E-clips 59
Spring 60
First side member 62*a*
Second side member 62*b*
Lower pin 63
Intermediate pin 64
Upper pin 65
Openings 66
Detents 68
Notch 69
Mounting pin 70
Springs 73
First side member 74*a*
Second side member 74*b*
Mounting pin 75
End portions 76
First pin 78
Second pin 80
Cross member 81
Third pin 82

Pin 84
Cam 86
Sleeve 88
Arm 90
Roller 92
Stop 94
Shaft 98
End portions 100
Hub 102
Upper arm 104
Lower arm 106
Lip 107
Projection 108
Forward portion 112
Intermediate portion 114
Rearward portion 116
First planar surface 118
Second planar surface 119
Step or lip 120
Rearward facing surface 121
Solenoid 122
Paddle 124
Bumpers 128
Surface 130
Pin 132
Switch 200
Switching assembly 202
Moving contact 204
Stationary contact 206
Closing spring assembly 207
Drive 208
Plunger 210
Primary coil 212
Secondary coil 216
Side plates 218

We claim:

1. An electrical switching device, comprising:

a sidewall;

a first shaft configured to translate between a first and a second position in relation to the sidewall;

a first contact mounted on the first shaft;

a second contact, wherein the first contact and the first shaft are configured so that the first contact is in electrical contact with the second contact when the first shaft is in the first position, and the first contact is out of electrical contact with the second contact when the first shaft is in the second position; and a damper and latching assembly comprising:

the first shaft;

a second shaft mounted for rotation on the sidewall, the second shaft being configured so that, during operation, the first shaft rotates the second shaft from a first to a second angular position of the second shaft as the first shaft moves from the first to the second position of the first shaft;

a first rotating member mounted for rotation on the sidewall between a first and a second angular position, the first rotating member comprising a third shaft, the third shaft being configured to, during operation, engage the first shaft when the first shaft is in the second position of the first shaft and the first rotating member is in the second angular position of the first rotating member, the engagement of the third shaft and the first shaft restraining the first shaft in the second position of the first shaft;

a second rotating member mounted on the second shaft and configured so that, during operation, rotation of the second shaft from the first to the second angular position of the second shaft causes the second rotating member to rotate from a first to a second angular position of the second rotating member; and a spring coupled to a third rotating member that is mounted for rotation on the sidewall and also coupled to the second rotating member, the third rotating member being configured so that, during operation, rotation of the second rotating member from the first to second angular position of the second rotating member causes the third rotating member to rotate from a first to a second angular position of the third rotating member, and the third rotating member imparts the energy to the first spring as the third rotating member is rotated from the first to the second angular position of the third rotating member, wherein rotation of the second shaft from the first to the second angular position of the second shaft imparts energy to the spring via the third rotating member, and at least a portion of the energy imparted to the spring biases the first rotating member toward the first angular position of the first rotating member as the first rotating member rotates from the second to the first angular position of the first rotating member.

2. The device of claim 1, wherein the first shaft is biased toward the first position of the first shaft and is configured to, during operation, move from the second to the first position of the first shaft as the first rotating member rotates from the second to the first angular position of the first rotating member.

3. The device of claim 1, wherein the spring is a torsion spring and is configured so that, during operation, the rotation of the third rotating member from the first to the second angular position of the third rotating member imparts the energy to the spring by winding the spring.

4. The device of claim 1, wherein the energization of the spring dampens the movement of the first shaft from the first to the second position of the first shaft.

5. The device of claim 1, wherein the third shaft has a substantially D-shaped cross section.

6. The device of claim 1, wherein:

the damper and latching assembly further comprises a solenoid, and a paddle connected to the solenoid, the solenoid being configured to, during operation, rotate the paddle between a first and a second angular position of the paddle; and the paddle is configured to contact the third rotating member when the third rotating member is in the second angular position of the third rotating member, and to rotate the third rotating member toward the first angular position of the third rotating member as the paddle moves from the first to the second angular position of the paddle.

7. The device of claim 1, wherein the third rotating member is configured so that, during operation, the third rotating member rotates the third shaft from the second to the first position of the third shaft as the third rotating member rotates from the second to the first position of the third rotating member, thereby releasing the first shaft from the third shaft.

8. The device of claim 1, wherein:

the first shaft comprises a step, and the third shaft is further configured to, during operation, engage the step when the first shaft is in the second position of the first shaft and the first rotating member is in the second angular position of the first rotating member; and the engagement of the step and the first shaft restrains the first shaft in the second position of the first shaft.

9. The device of claim 1, wherein:

the first shaft has a substantially planar surface;

the second shaft has a substantially planar surface configured to, during operation, contact the surface of the first shaft as the first shaft rotates the second shaft from the first to the second angular position of the second shaft; and an orientation of the surface the first shaft substantially matches an orientation of the surface of the second shaft as the first shaft rotates the second shaft from the first to the second angular position of the second shaft.

10. The device of claim 1, wherein the first shaft is configured to, during operation, prevent rotation of the first rotating member from the first to the second position of the first rotating member when the first shaft is in the first position of the first shaft.

11. The device of claim 1, wherein the first rotating member is configured so that, during operation, rotation of the third rotating member from the first to the second angular position of the third rotating member causes the first rotating member to rotate from the first to the second angular position of the first rotating member.

12. The device of claim 11, wherein:

the spring is a first spring;

the damper and latching assembly further comprises a second spring coupled to the first rotating member and the sidewall; and the second spring is configured to, during operation, bias the first rotating member toward the second angular position of the first rotating member.

13. The device of claim 1, wherein:

the damper and latching assembly further comprises a coupling member, a mounting pin that engages the coupling member and the second rotating member, and a coupling pin that engages the coupling member and the third rotating member;

the second rotating member is coupled to the third rotating member by way of the coupling member, the mounting pin, and the coupling pin; and the coupling member is configured so that, during operation, the coupling pin is disengaged from the third rotating member when the second rotating member is in the second angular position of the second rotating member thereby decoupling the third rotating member from the second rotating member.

14. The device of claim 13, wherein:

the third rotating member comprises a side member having an opening formed therein; and the coupling pin is configured to, during operation, reside within the opening and out of contact with the third rotating member when the second rotating member is in the second angular position of the second rotating member.

15. The device of claim 13, wherein:

the spring is a first spring;

the damper and latching assembly further comprises a second spring coupled to the coupling member and the second rotating member; and the second spring is configured to, during operation, bias the coupling member in an orientation at which coupling pin remains disengaged from the third rotating member when the second rotating member is in the second angular position of the second rotating member.

16. The device of claim 1, wherein the spring is further configured to, during operation, bias the third rotating member toward the first angular position of the third rotating member as the third rotating member rotates from the second to the first angular position of the third rotating member.

17. The device of claim 16, wherein the spring is further configured to bias the third rotating member toward the first position of the third rotating member using at least a portion of the energy imparted to the spring by the rotation of the second shaft from the first to the second angular position of the second shaft.

18. The device of claim 16, wherein the spring is further configured to, during operation, bias the third rotating member toward the second position of the third rotating member when the third rotating member is in the second angular position of the third rotating member.

* * * * *